US010871263B2

(12) United States Patent
Yaphe et al.

(10) Patent No.: US 10,871,263 B2
(45) Date of Patent: Dec. 22, 2020

(54) SUPPORTING ACCESSORIES FOR CEILING STRUCTURES

(71) Applicant: Axis Lighting Inc., Lasalle (CA)

(72) Inventors: Howard Yaphe, Lasalle (CA); Jody Arsenault, Lasalle (CA); Andrew Miles, Lasalle (CA); Rodel Carbo, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 0 days.

(21) Appl. No.: 16/381,801

(22) Filed: Apr. 11, 2019

(65) Prior Publication Data

US 2019/0301691 A1 Oct. 3, 2019

Related U.S. Application Data

(63) Continuation of application No. 15/189,199, filed on Jun. 22, 2016, now Pat. No. 10,288,238, which is a (Continued)

(30) Foreign Application Priority Data

Dec. 18, 2015 (CA) ..... 166060

(51) Int. Cl.

| | |
|---|---|
| ***F21V 7/05*** | (2006.01) |
| ***E04B 9/00*** | (2006.01) |
| ***F21V 21/04*** | (2006.01) |
| ***F21Y 115/10*** | (2016.01) |
| ***E04B 9/04*** | (2006.01) |
| ***E04B 9/12*** | (2006.01) |
| ***E04B 9/24*** | (2006.01) |
| ***F21S 8/02*** | (2006.01) |
| ***F21V 3/04*** | (2018.01) |

(52) U.S. Cl.

CPC ..... *F21S 8/026* (2013.01); *E04B 9/006* (2013.01); *F21V 3/04* (2013.01); *F21V 7/05* (2013.01); *F21V 21/048* (2013.01); *E04B 9/0428* (2013.01); *E04B 9/127* (2013.01); *E04B 9/241* (2013.01); *F21Y 2115/10* (2016.08)

(58) Field of Classification Search

CPC ..... E04B 9/006; E04B 9/0428; E04B 9/127; E04B 9/241; F21S 8/026; F21V 21/048; F21V 3/04; F21V 7/05; F21Y 2115/10

See application file for complete search history.

(56) References Cited

U.S. PATENT DOCUMENTS 3,204,547 A 9/1965 Ericson
3,545,145 A 12/1970 Yousefpor
(Continued)

OTHER PUBLICATIONS

U.S. Office Action dated Jan. 15, 2016 issued in U.S. Appl. No. 14/747,645.

(Continued)

*Primary Examiner* — Tsion Tumebo
(74) *Attorney, Agent, or Firm* — Weaver Austin Villeneuve & Sampson LLP

(57) ABSTRACT

A light fixture for mounting in a t-bar ceiling structure, the light fixture includes a housing configured to support a ring-shaped lens to at least partially surround an inner reflective surface, the inner reflective surface being configured to at least partially reflect light incident thereon from the lens, to present a mirage effect in a transition zone near the lens.

13 Claims, 25 Drawing Sheets

Related U.S. Application Data continuation-in-part of application No. 14/747,645, filed on Jun. 23, 2015, now Pat. No. 9,416,535, application No. 16/381,801, filed on Apr. 11, 2019, which is a continuation-in-part of application No. 29/568,080, filed on Jun. 15, 2016, now Pat. No. Des. 859,719, which is a continuation-in-part of application No. 14/747,645, filed on Jun. 23, 2015, now Pat. No. 9,416,535.

(56) References Cited

U.S. PATENT DOCUMENTS 3,609,338 A * 9/1971 Kripp ..... F21V 21/04 362/366
3,941,995 A 3/1976 Fritz
4,075,775 A 2/1978 Shorette
4,086,480 A 4/1978 Lahm
4,175,360 A 11/1979 Mulvey
4,232,594 A 11/1980 Kuhr
4,263,639 A 4/1981 Schacht
4,290,218 A 9/1981 Drueck
4,479,341 A * 10/1984 Schuplin ..... E04B 9/127 52/506.07
4,528,764 A 7/1985 Cobb
4,580,387 A 4/1986 Rogers
4,646,212 A 2/1987 Florence
4,947,570 A 8/1990 May et al.
5,045,985 A * 9/1991 Russo ..... E04B 9/006 248/214
6,029,414 A * 2/2000 MacLeod ..... E04B 9/006 248/231.81
6,116,750 A 9/2000 Hentz
6,179,451 B1 1/2001 Bodine et al.
6,345,800 B1 * 2/2002 Herst ..... E04B 9/006 248/342
6,350,046 B1 2/2002 Lau
D454,210 S 3/2002 Lindgren et al.
7,255,315 B2 * 8/2007 Oh ..... F16L 3/24 248/342
7,374,057 B2 5/2008 Hendrickson et al.
7,399,104 B2 7/2008 Rappaport
D604,894 S 11/2009 Peifer
7,735,794 B1 * 6/2010 Gretz ..... E04B 9/006 248/343
7,753,550 B2 7/2010 Engel
7,771,085 B2 8/2010 Kim
7,874,708 B1 * 1/2011 Jones ..... F21V 21/048 248/220.22
D649,678 S 11/2011 Germain et al.
8,091,721 B1 * 1/2012 Gretz ..... H02G 3/20 220/3.9
8,109,482 B2 * 2/2012 Oh ..... A62C 35/68 248/342
D655,853 S 3/2012 Kim et al.
8,256,151 B2 9/2012 Stafford et al.
D668,371 S 10/2012 Alpasian et al.
D679,437 S 4/2013 Watt
D690,867 S 10/2013 Mayfield, III
D690,868 S 10/2013 Mayfield, III
8,616,736 B2 12/2013 Pan
8,950,898 B2 2/2015 Catalano
9,062,838 B1 6/2015 Merrill
D738,032 S 9/2015 Maxik et al.
D748,842 S 2/2016 Sakurai et al.
9,416,535 B1 8/2016 Yaphe et al.
9,459,397 B2 10/2016 Boomgaarden et al.
D779,105 S 2/2017 Krueckeberg et al.
9,581,756 B2 2/2017 Boomgaarden et al.
D784,593 S 4/2017 Ambrozus
9,625,133 B2 4/2017 Mandy et al.
D790,114 S 6/2017 Chung et al.
9,726,339 B2 8/2017 Hierzer
10,288,238 B2 5/2019 Yaphe et al.
D859,719 S 9/2019 Yaphe et al.
2004/0213003 A1 10/2004 Lauderdale et al.
2007/0180787 A1 * 8/2007 Fecska ..... E04B 9/127 52/506.06
2008/0170398 A1 7/2008 Kim
2010/0079983 A1 4/2010 Kumamoto
2011/0176295 A1 * 7/2011 Chang ..... F21V 21/04 362/147
2013/0301249 A1 11/2013 Ngai et al.
2014/0055995 A1 2/2014 Kang et al.
2014/0063776 A1 3/2014 Clark et al.
2014/0223753 A1 8/2014 Yaphe et al.
2014/0238717 A1 * 8/2014 Korcz ..... F16M 13/027 174/50
2015/0276176 A1 10/2015 Ju et al.
2016/0116136 A1 4/2016 Bernard et al.
2016/0377245 A1 12/2016 Yaphe et al.
2017/0009942 A1 1/2017 Myers et al.

OTHER PUBLICATIONS

U.S. Notice of Allowance dated May 5, 2016 issued in U.S. Appl. No. 14/747,645.
U.S. Office Action dated Jun. 23, 2017 issued in U.S. Appl. No. 15/189,199.
U.S. Final Office Action dated Dec. 26, 2017 issued in U.S. Appl. No. 15/189,199.
U.S. Office Action dated Jun. 1, 2018 issued in U.S. Appl. No. 15/189,199.
U.S. Notice of Allowance dated Dec. 31, 2018 issued in U.S. Appl. No. 15/189,199.
U.S. Restriction Requirement dated Sep. 22, 2017 issued in U.S. Appl. No. 29/568,080.
U.S. Office Action dated Aug. 16, 2018 issued in U.S. Appl. No. 29/568,080.
U.S. Notice of Allowance dated Feb. 4, 2019 issued in U.S. Appl. No. 29/568,080.

* cited by examiner

SUPPORTING ACCESSORIES FOR CEILING STRUCTURES

PRIORITY DATA

This patent document is a continuation of and claims priority of U.S. patent application Ser. No. 15/189,199, filed Jun. 22, 2016, entitled SUPPORTING ACCESSORIES FOR CEILING STRUCTURES, which is a continuation-in-part of and claims priority of U.S. patent application Ser. No. 14/747,645, now U.S. Pat. No. 9,416,535, filed Jun. 23, 2015, entitled SUPPORTING ACCESSORIES FOR CEILING STRUCTURES. This patent document also is a continuation-in-part of and claims priority of U.S. patent application Ser. No. 29/568,080, filed Jun. 15, 2016, entitled LUMINAIRE, which: 1) is a continuation-in-part of and claims priority of U.S. patent application Ser. No. 14/747,645, and 2) claims priority of Canadian Industrial Design Application No. 166060, filed Dec. 18, 2015, entitled LUMINAIRE. The entire disclosures of U.S. patent application Ser. No. 15/189,199, U.S. patent application Ser. No. 14/747,645 and U.S. patent application Ser. No. 29/568,080, including all materials originally submitted to the U.S. Patent and Trademark Office, are hereby incorporated by reference for all purposes.

FIELD OF THE DISCLOSURE

The present disclosure relates to ceiling mounted accessories, such as light fixtures, and to methods and devices for supporting them in designed openings in ceiling structures.

BACKGROUND

T-bar ceiling configurations were introduced in the 1950's and have become, since then, a standard approach to provide a versatile decorative finish while also providing ready access to, and concealing, utility infrastructure. Corresponding developments have been seen in the deployment of light fixtures in t-bar ceiling configurations.

While satisfactory for their intended purposes, conventional t-bar ceiling configurations and accessories for installation in such configurations in some cases lack a degree of flexibility demanded by customers in response to emerging trends in interior design.

SUMMARY

In one aspect, there is provided a support assembly for supporting one or more ceiling accessories in a designated opening in a t-bar ceiling structure, comprising a plurality of support braces, each support brace configured to bridge a first ceiling accessory locating region alongside a corresponding boundary of the designated opening. Each support brace may be configured to provide support for at least one second ceiling accessory alongside the first ceiling accessory locating region in the designated opening, for the second and first ceiling accessories to complement a finished ceiling presentation provided by the t-bar ceiling structure.

In some embodiments, the first ceiling accessory includes a light fixture and the second accessory includes at least one t-bar ceiling structural unit to support at least one ceiling panel.

Some exemplary embodiments further comprise the light fixture, wherein the light fixture provides one or more first support surfaces to align with one or second support surfaces on the t-bar ceiling structural unit to support the ceiling panel.

In some exemplary embodiments, the light fixture may be configured to extend along one or more edge regions of the designated opening. For instance, in one example, the designated opening may have four edge regions and the light fixture may be configured to extend along the four edge regions.

In some exemplary embodiments, the t-bar ceiling structure may define a first elevation and each support brace may be configured to bridge the first ceiling accessory locating region at a second elevation spaced from the first elevation.

In some exemplary embodiments, each support brace may be configured to cantilever from a boundary of the designated opening. Each brace may include a first coupler to couple with the designated t-bar ceiling structure, and a second coupler to couple with the t-bar ceiling structural unit. The first and/or second couplers may be adjustable relative to the brace. At least one of the first and/or second couplers may include a fixed segment and a movable segment which is adjustably positionable relative thereto. The fixed and movable segments include complementary passages which are alignable to receive at least one fastener, thus to fix the position of the movable segment.

In some exemplary embodiments, the brace includes a central span to support the first and second couplers. The central span portion may include a proximal span portion and a pair of distal span portions, where at least one of which may be adjustably fixable to the central span portion.

In some exemplary embodiments, each of the first and second couplers may include a leg section and a clip formation integrally formed therewith, each clip formation including a clip element biased toward the corresponding leg section, with one or more first surface regions to engage corresponding surface regions on an upright sector of the t-bar structure.

Some exemplary embodiments may further comprise a third coupler for mounting the light fixture to the brace.

Some exemplary embodiments may further comprise the ceiling panel which is configured to provide a reflective surface for reflecting light, at least in part, from the light fixture.

Some exemplary embodiments may further comprise the t-bar structural unit.

In another aspect, there is provided a method of supporting one or more ceiling accessories in a designated opening in a t-bar ceiling structure, comprising:

a. locating a ceiling accessory to be supported in the designated opening, so that the ceiling accessory is positioned adjacent a boundary of the designated opening;

b. locating a plurality of support braces at spaced locations along the designated opening by anchoring a first coupler on each support device at a respective one of the spaced locations to extend the support braces into the designated opening;

c. providing at least one t-bar ceiling structural unit between at least two of the support braces; and d. locating at least one ceiling panel on the at least one t-bar ceiling structural unit in the designated opening and adjacent the ceiling accessory, thereby to form an esthetic transition across the ceiling panel, the accessory and a finished appearance provided by the t-bar ceiling structure.

In some exemplary embodiments, each support brace may include a second coupler spaced from the first coupler, further comprising:

e. anchoring the t-bar ceiling structural unit to the second couplers of two said opposed support braces.

In some exemplary embodiments the support braces may be located before locating the ceiling accessory.

In another aspect, there is provided a support device for supporting one or more ceiling accessories in a designated opening in a t-bar ceiling structure, comprising a span portion configured to bridge a first accessory locating region alongside a corresponding boundary of the designated opening. A first coupler is provided to couple with a designated sector of the t-bar ceiling structure near the designated opening. Each support brace is configured to provide support for at least one second accessory alongside the first accessory locating region in the designated opening, so that the a first accessory, and the second accessory are complementary with a finished ceiling presentation provided by the t-bar ceiling structure.

In some embodiments, the first accessory includes a light fixture and the second accessory includes a t-bar structural unit, further comprising a second coupler to couple with the t-bar ceiling structural unit, to extend through the designated opening to support one or more ceiling panels.

In some embodiments, one or both of the first and second couplers are adjustable relative to the span portion.

In some embodiments, one or both of the first and second couplers includes a leg and a clip biased toward the leg to engage a designated section of the t-bar ceiling structure, the t-bar structural unit, respectively.

In another aspect, there is provided a light fixture for mounting in a t-bar ceiling structure. The light fixture comprises a housing with an open end region to receive optics therein, and a pair of opposed mounting flanges extending laterally outwardly from the housing near the open end region on opposite sides thereof, wherein one of said mounting flanges is offset relative to another of said mounting flanges.

In another aspect, there is provided a light fixture for mounting in a t-bar ceiling structure. The light fixture comprises a housing configured to support a ring-shaped lens to at least partially surround an inner reflective surface. The inner reflective surface is configured to at least partially reflect light incident thereon from the lens, to present a mirage effect in a transition zone near the lens.

Some exemplary embodiments may further comprise a mounting configuration for installing the light fixture with the housing adjacent an outer presentation surface of the t-bar ceiling structure.

Some exemplary embodiments may further comprise a lens interface for installing the lens, wherein the mounting configuration is configured to align the lens interface to be aligned with the outer presentation surface.

In some exemplary embodiments, the housing may be ring-shaped to define a corresponding ring-shaped opening to receive the ring-shaped lens therein.

Some exemplary embodiments may further comprise at least one support flange to support a reflective planar member providing the inner reflective surface. The support flange may be configured to locate the inner reflective surface to be substantially coplanar with a corresponding plane of the t-bar ceiling structure.

Some exemplary embodiments may further comprise the planar member.

In some exemplary embodiments, the lens may be configured to extending along an entire periphery of the inner reflective surface.

In some exemplary embodiments, the lens may have light-transmissive sections separated by nonlight-transmissive sections.

In some exemplary embodiments, the lens may be elongate in cross section, including configurations with a rectangular cross sectioned outer region.

In some exemplary embodiments, the housing may rectangular ring-shaped.

In yet another aspect, there is provided the ornamental design for a light fixture accessory, as shown and described.

BRIEF DESCRIPTION OF THE FIGURES

Several embodiments of the present disclosure will be provided, by way of examples only, with reference to the appended drawings, wherein.

DETAILED DESCRIPTION

Figure 1:
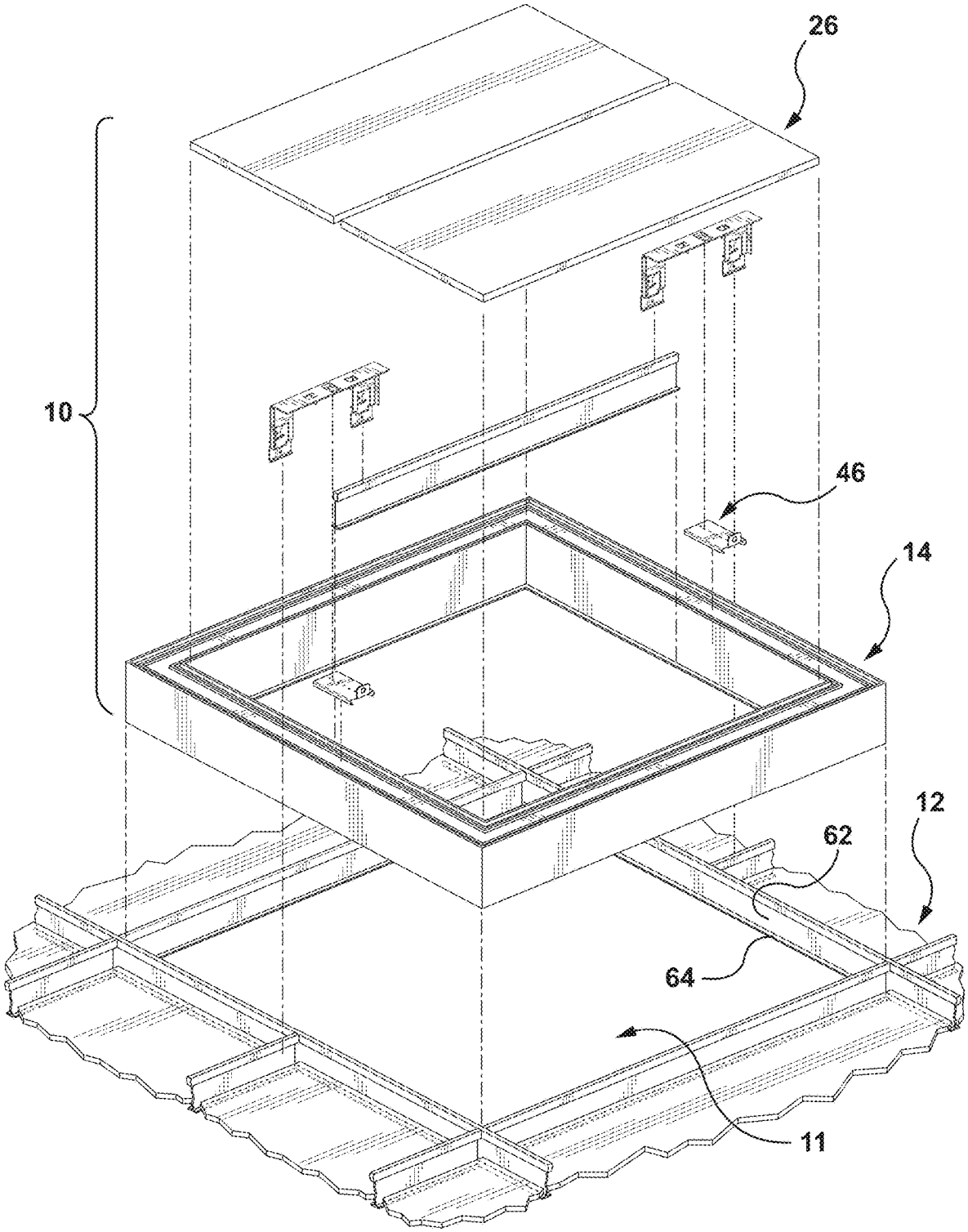
FIG. 1 is a fragmentary assembly perspective view of a t-bar ceiling structure installation.
Figure 2:
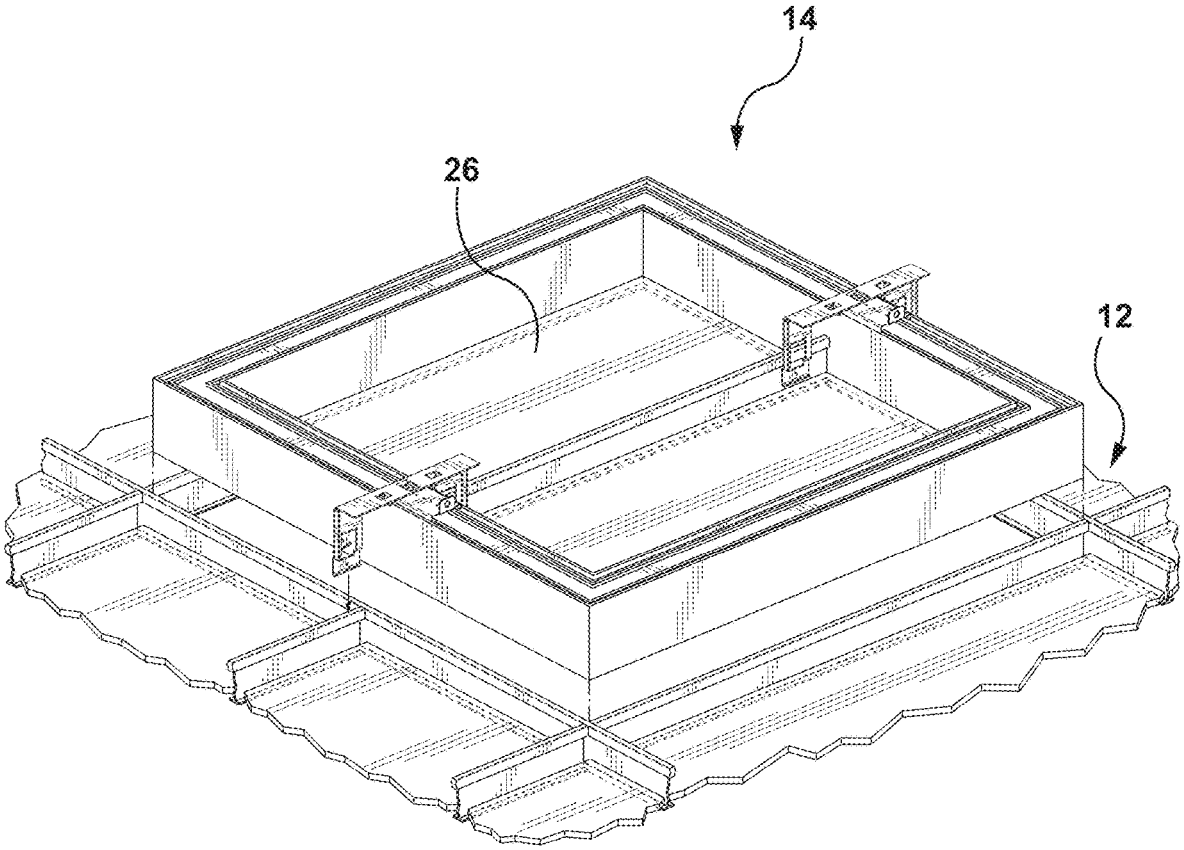
FIG. 2 is another fragmentary assembly perspective view of the installation of FIG. 1.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or electrical connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or electrical or other configurations are possible which are considered to be within the teachings of the instant disclosure.

The term "ring-shaped" describes an object that has an annular shape that may be circular, rectangular or other configuration, in both plan and in lateral cross section, to form an inner region bordered by the object. Examples include square and circular annuli or toroids. The shape may be substantially continuous or alternatively have one or more discontinuities while still being ring shaped. A ring-shaped object may have a repeating pattern of partial yet complementary ring-shaped components in a ring-shaped configuration.

The term "light-transmissive" means having the ability to transmit light, as applied in this case to a lens which may be transparent or translucent. The term nonlight-transmissive means having substantially no ability to transmit light, as would apply to a structure in front of a light source, where substantially no light may be transmitted therethrough, such as an opaque section on a lens.

Figure 9:
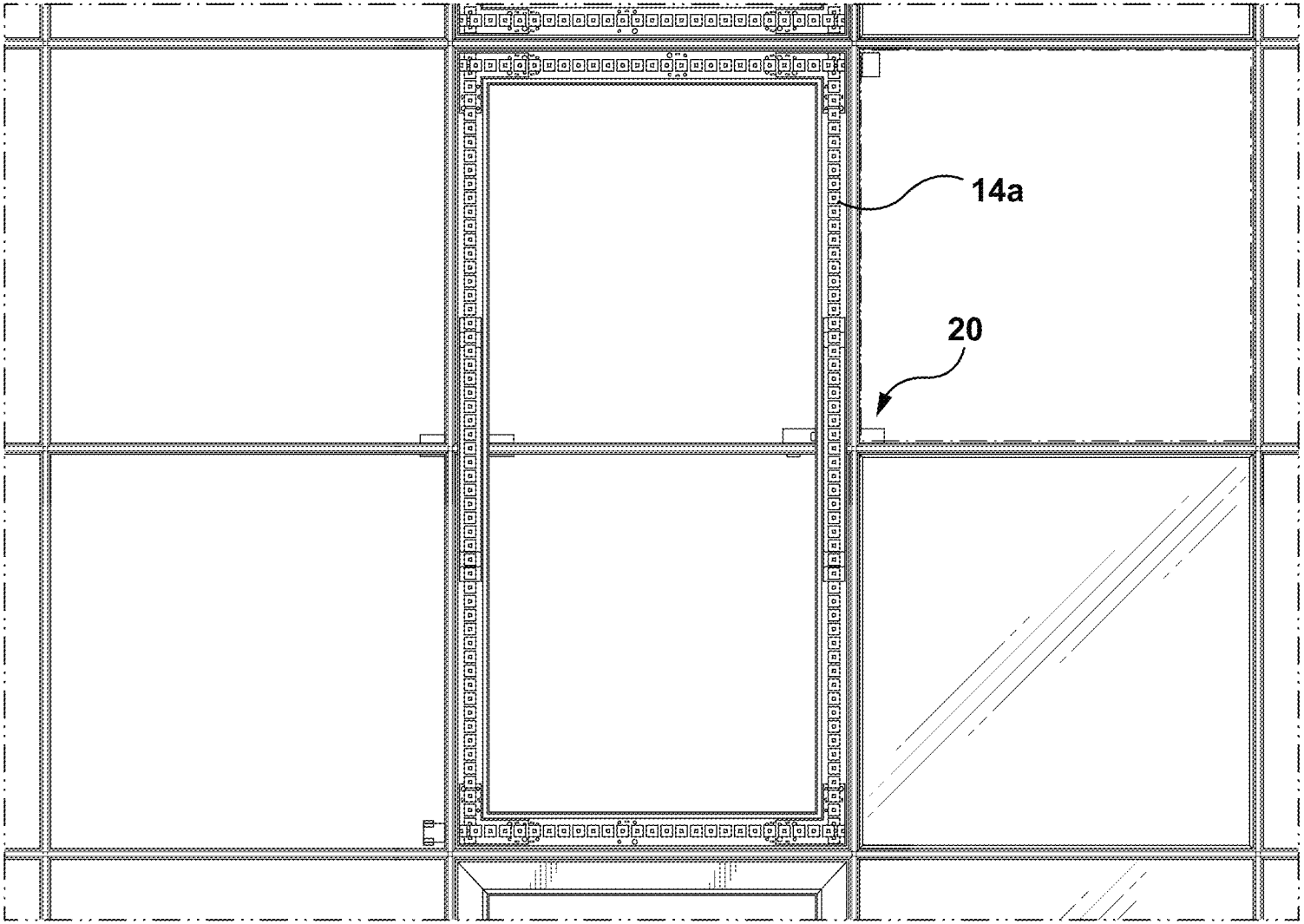

Referring to the figures, exemplary embodiments provide a support assembly 10 for supporting ceiling accessories in a designated opening 11 in a t-bar ceiling structure 12. The figures illustrate an exemplary first accessory in the form of an LED light fixture 14 (with LED's 14*a* shown in FIG. 9), though other fixtures and accessories may also be utilized, such as for air circulation, or other illumination or decorative configurations and the like, without departing from the scope of the present disclosure.

Figure 5:
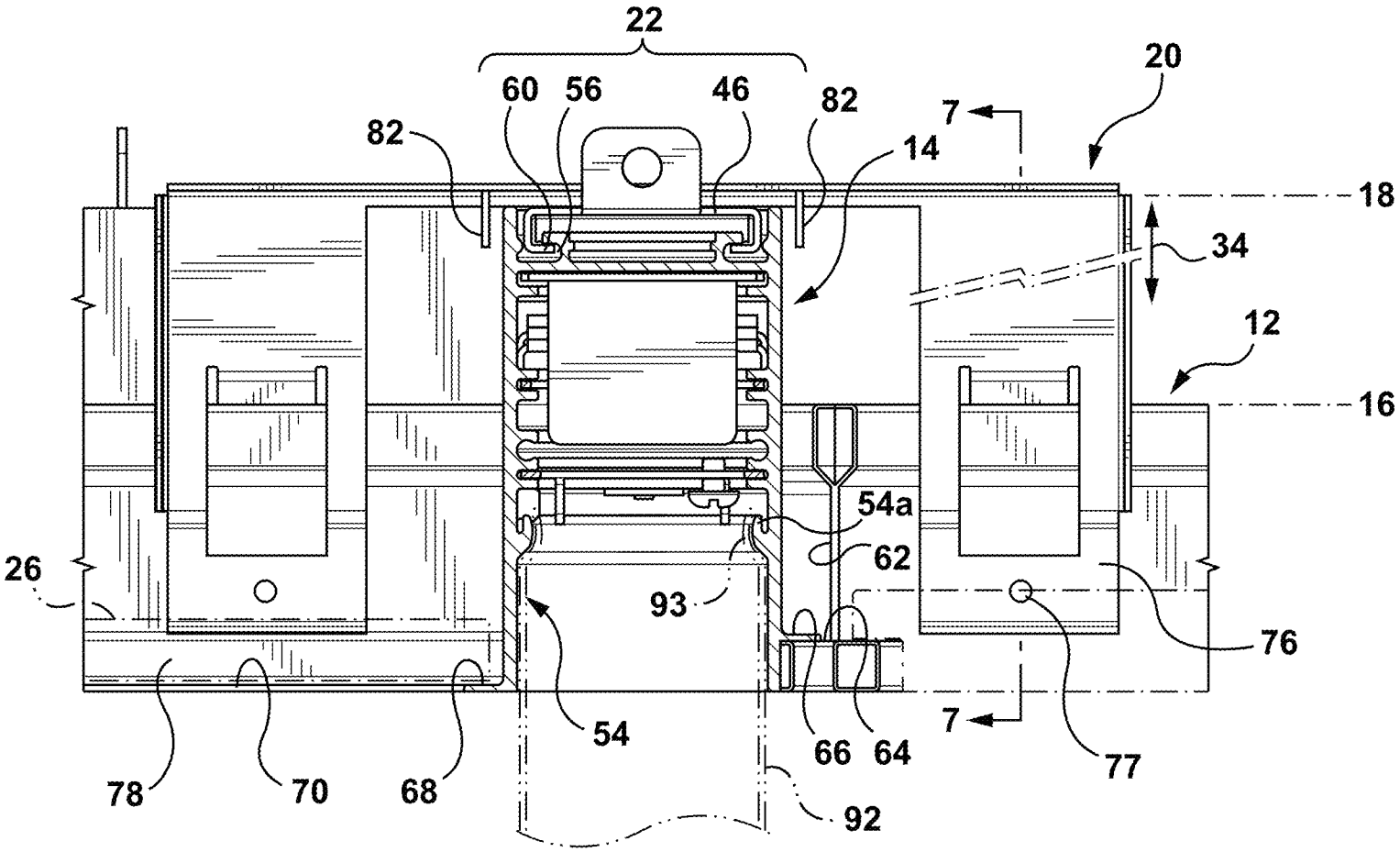
FIG. 5 is a sectional view taken on line 5-5 of FIG. 3.
Figure 5A:
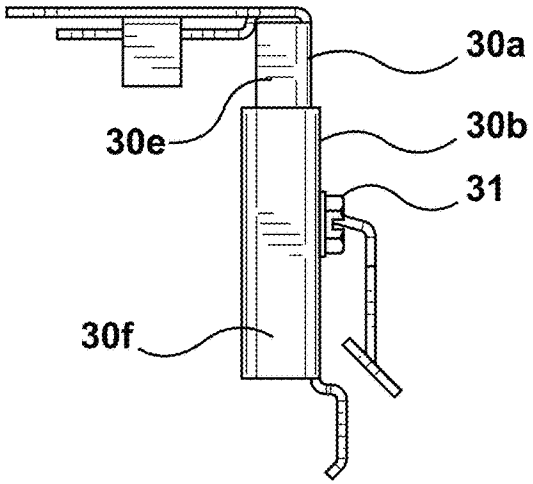
FIGS. 5*a* to 5*f* show alternative variations of a portion of the installation shown in FIG. 3.
Figure 5B:
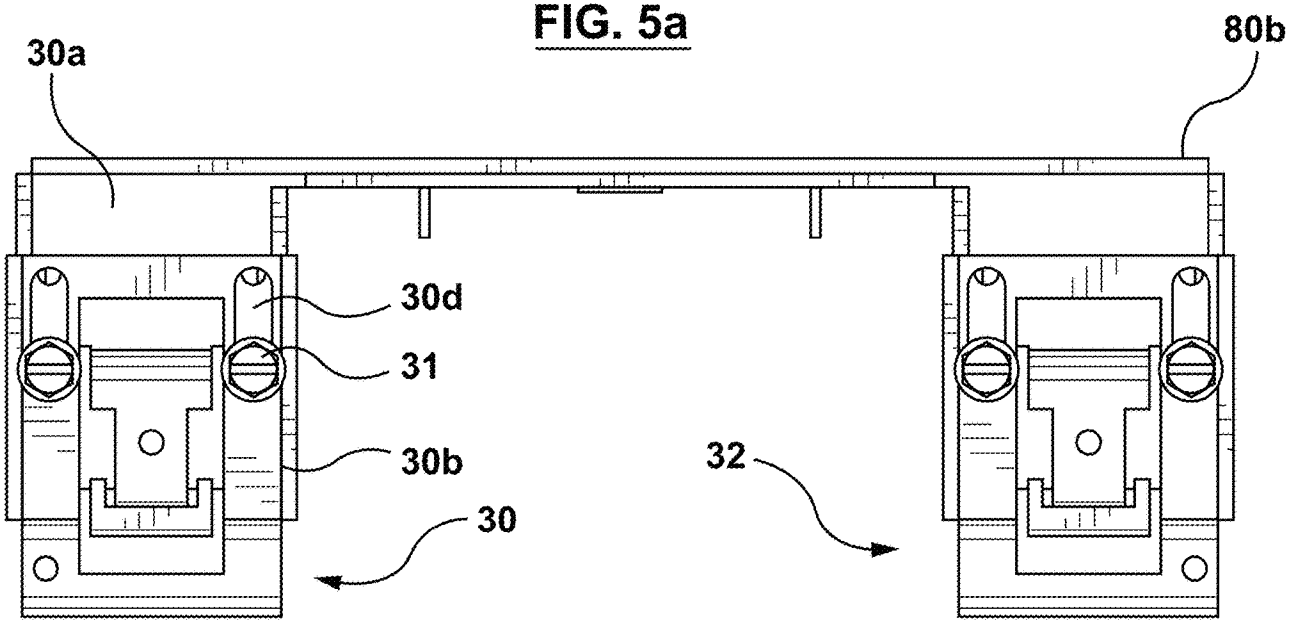
Figure 5C:
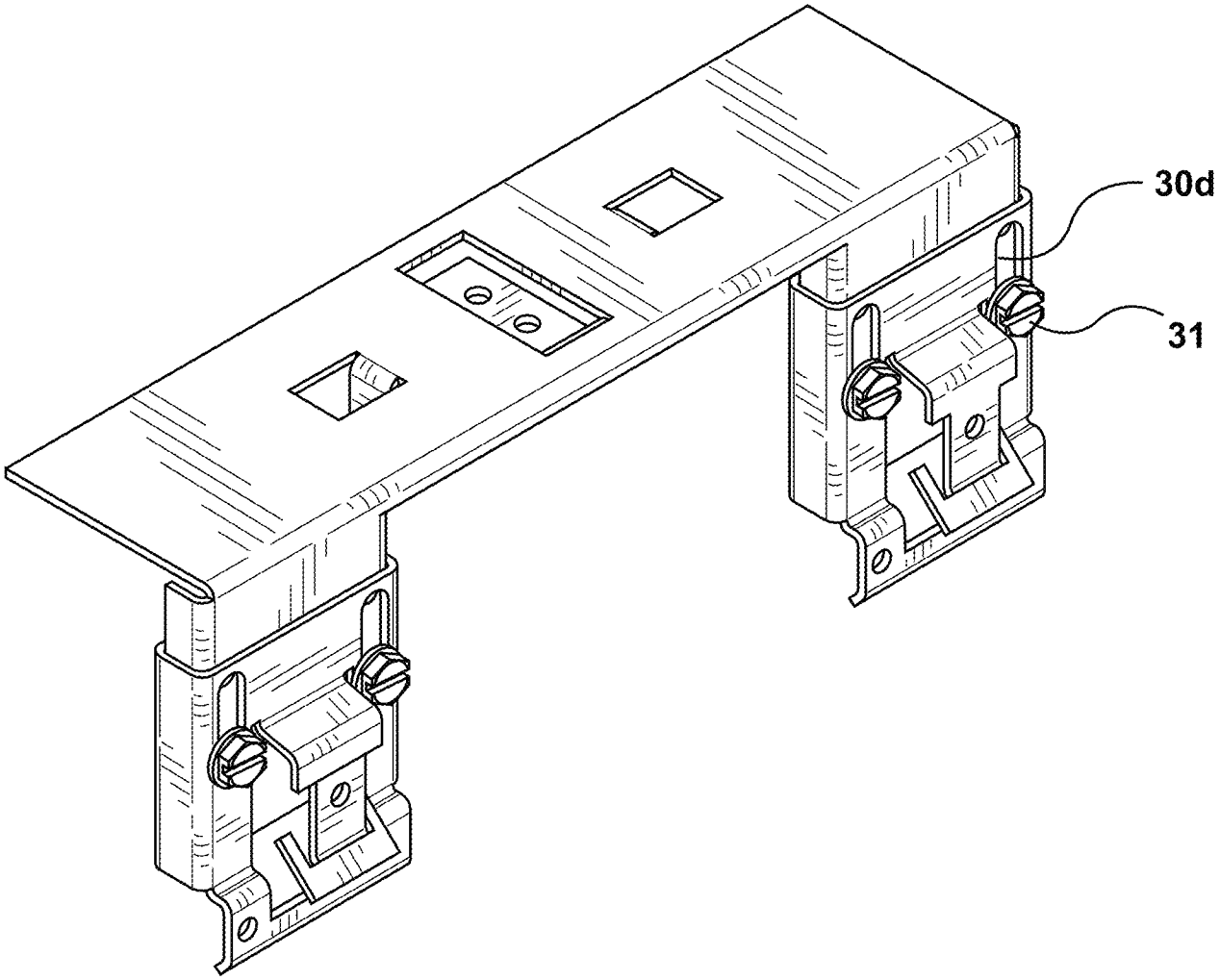
Figure 5E:
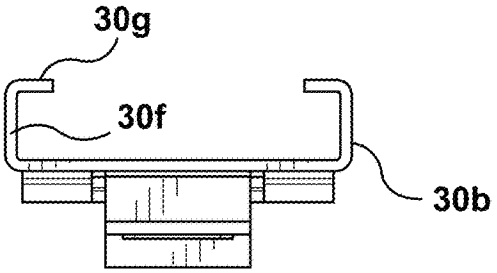
Figure 5D:
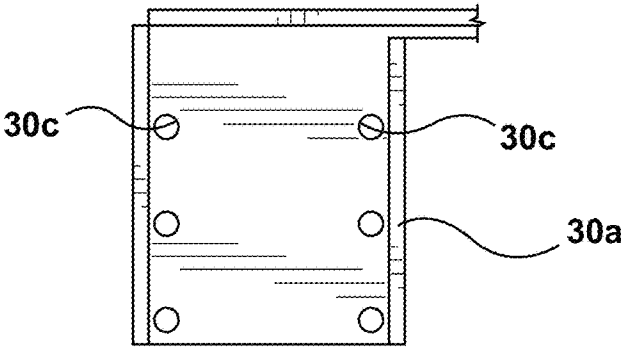

Referring to FIG. 5, the t-bar ceiling structure 12, in this case, forms a first elevation 16. A plurality of support braces, are provided, with one of which shown at 20. Each support brace 20 is configured to bridge (at a second elevation 18 which is upwardly spaced from the first elevation 16) an accessory locating region 22 alongside a corresponding boundary of the designated opening, and defined by the inner exposed surfaces 62, as well as the lower support flanges 64, on the neighboring t-bar ceiling structure 12. Alternatively, the support braces 20 may be configured to bridge the accessory region at a substantially common elevation with the t-bar ceiling structure, without departing from the scope of the present disclosure.

Each support brace 20 is further configured to provide support for at least one second accessory, in this example in the form of a ceiling panel 26 (shown in chain dotted lines at 26 in FIG. 5) beside the accessory locating region 22, which itself is in the designated opening 11, so that the light fixture 14 and the ceiling panel 26 cooperate to complement a finished ceiling presentation provided by the t-bar ceiling structure.

Figure 3:
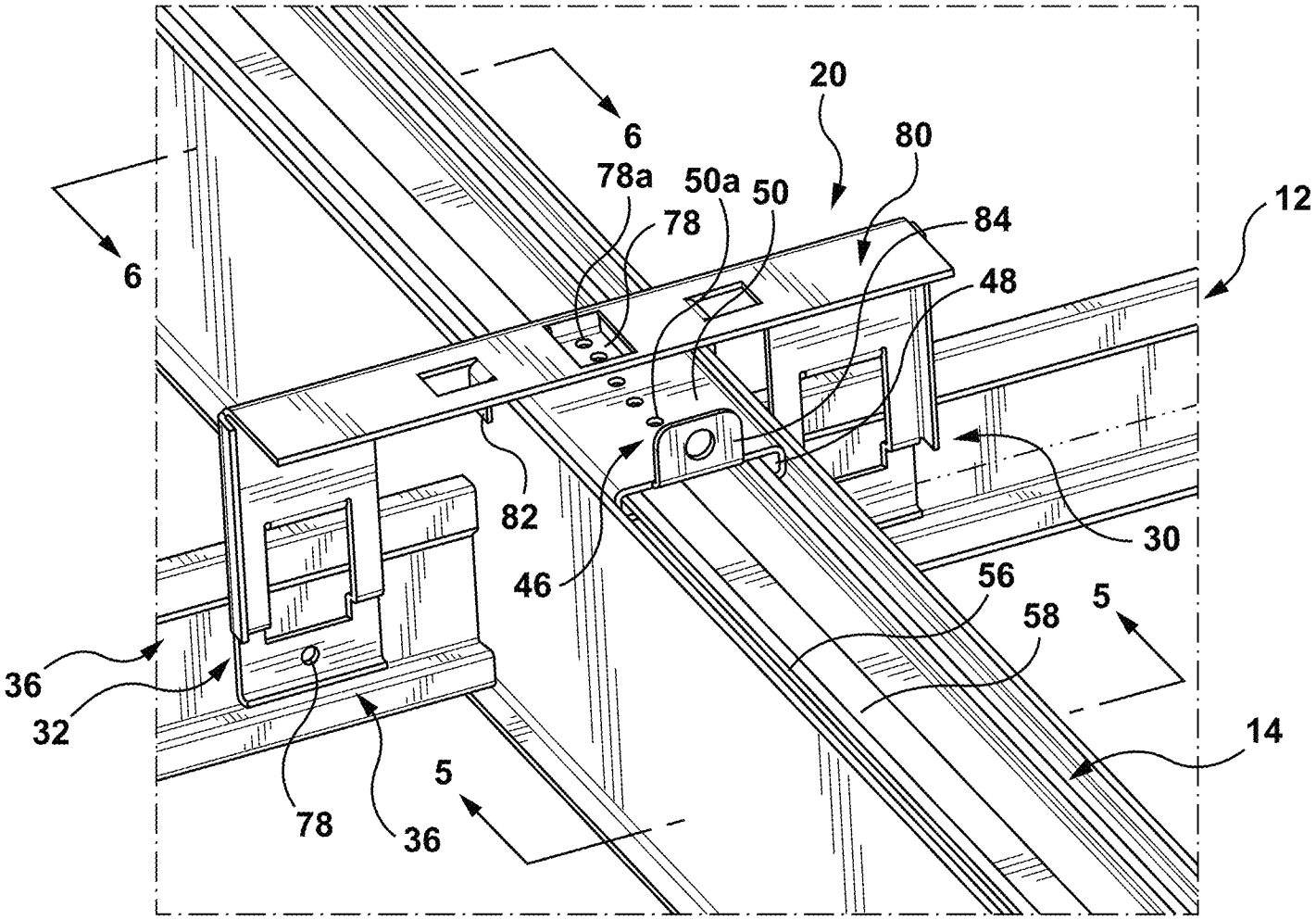
FIGS. 3 and 4 are fragmentary perspective views of portions of the installation of FIG. 1.

Referring to FIG. 3, the support braces 20 are each configured to cantilever from an anchored position on the t-bar ceiling structure 12 and extend inwardly from opposite boundaries of the designated opening 11. To achieve this, each support brace 20 is provided with a first coupler 30 (on the right hand side of the support brace 20 as seen in FIG. 3), for coupling with the designated t-bar ceiling structure 12.

At its opposite end, each brace includes a second coupler 32 for coupling with a t-bar ceiling structural unit 36, for the latter to extend at least partially through the designated opening 11 to support the ceiling panel 26. The t-bar ceiling structural unit 36, thus, is not part of the structure making up the t-bar ceiling structure 12. It is an auxiliary element which is located inside the designated opening 11 and extends through an opening in the light fixture 14, which itself is located in the designated opening 11. Thus, the ends of the t-bar ceiling structural unit 36 are not joined integrally with the t-bar ceiling structure, but rather indirectly through the respective bridging of the support braces 20, with the bridging defining the accessory locating region 22.

In the exemplary embodiments shown in the figures, the first and second couplers 30, 32 are integrally formed with the support brace 20, though other configurations may be provided in which the support brace and one or more of the first and second couplers 30, 32 are separate from the support brace 20 and releasably coupled thereto, without departing from the scope of the present disclosure. Furthermore, as separate articles, the first and second couplers 30, 32, if desired, may be adjustable for vertical adjustment as shown by the representation at arrow 34 in FIG. 5, in an operative position, to allow for differences in elevation to accommodate variations in ceiling structure configurations.

FIGS. 5*a* to 5*e* show a variation, in which each of the couplers 30, 32 includes fixed and movable segments which are shown for coupler 30 at 30*a* and 30*b*. Fixed segment 30*a* has two rows of aligned passages 30*c*, with each row to receive a set screw 31 in one of the passages 30*c*. The movable segment 30*b* has a pair of elongate passages 30*d*, each of which is aligned with a corresponding row to receive set screw 31 therein to define the movement of, and to fix the position of, the movable segment 30*b* relative to fixed segment 30*a*. Further, the fixed and movable segments 30*a*, 30*b* have slidably engaged inner and outer stiffening webs 30*e* and 30*f* respectively, with the outer stiffening web 30*f* provided with inturned distal end regions 30*g* to contain the inner stiffening web 30*e* therebetween. Other variations may be configured to provide adjustments in the positions of the couplers and their length by the use of complementary and/or mating adjacent parts which are slidably or otherwise moveable relative to one another and fixable in one of a number of positions afforded by such relative mobility.

Figure 5F:
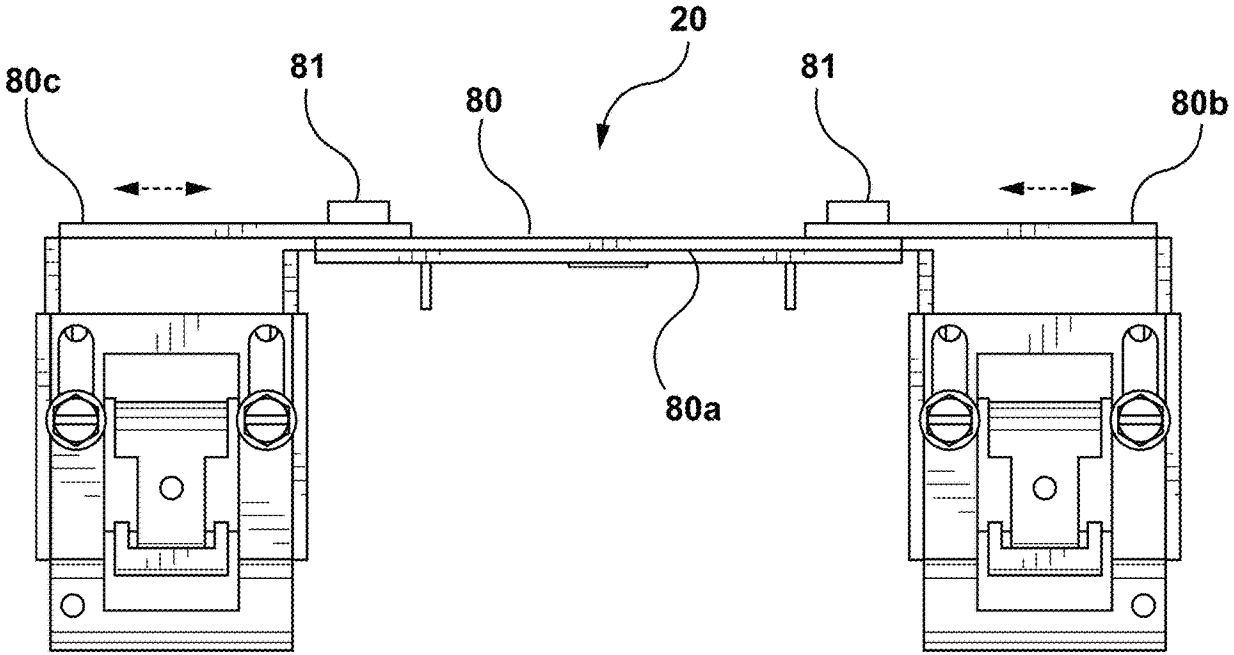
Figure 6:
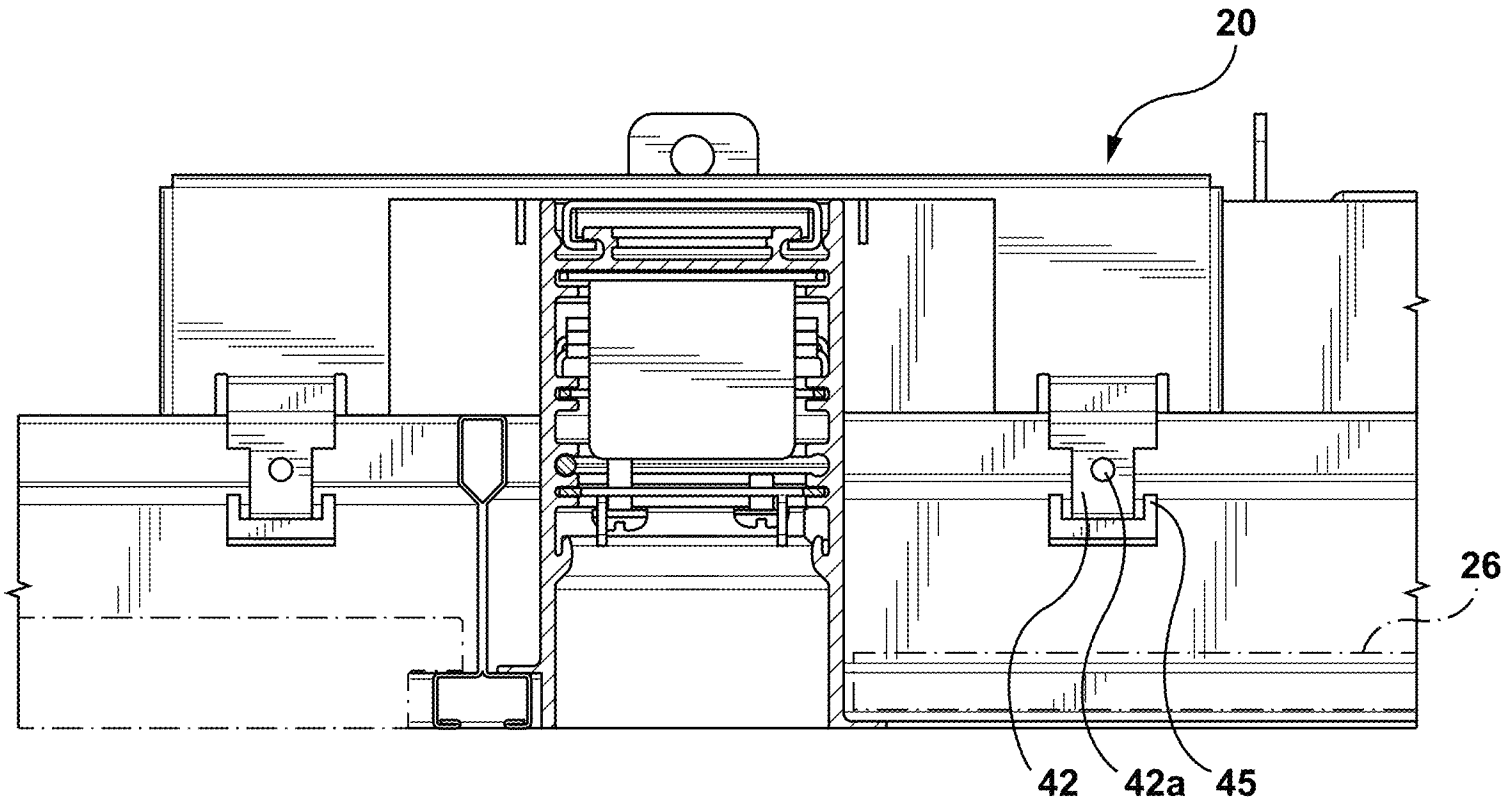
FIG. 6 is a sectional view taken on line 6-6 of FIG. 3.

Referring to FIG. 5*f*, similar relative movement/adjustability and fixability may be applied to the configuration of the support brace 20, for example by forming central span 80 with a proximal span portion 80*a* which may be adjustably coupled to one or more distal span portions 80*b* and 80*c* slidably adjustable relative thereto with set screws 81 to hold them in a particular configuration. This configuration may also be provided with one of the distal span portions adjustably coupled and the other of the distal span portions integrally formed with the central span 80, as may be desirable in some cases.

Figure 7:
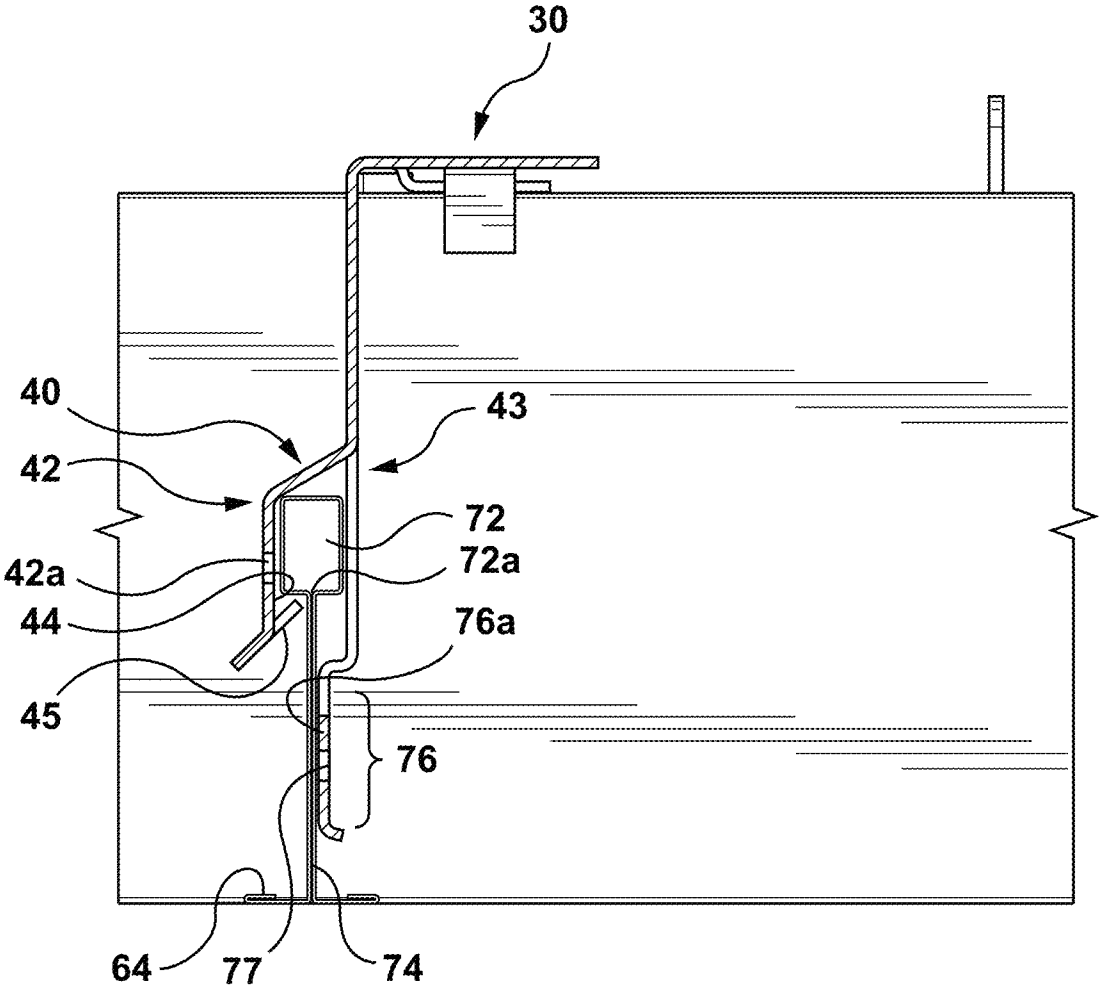
FIG. 7 is a sectional view taken on line 7-7 of FIG. 5.

Referring to FIG. 7, each of the first and second couplers 30, 32 includes clip formations 40 integrally formed with a corresponding leg section 43. Each clip formation 40 includes a clip element 42 biased toward the corresponding leg section 43, with one or more clip surface regions 44 to engage corresponding surface regions on an upright sector of the t-bar structure, which in the configuration shown includes an upper rectangular section 72, a pair of opposed flanges 64 and an upright web 74 between them. Furthermore, each clip element 42 has a locking end tab 45 which, when installed, is located in a corner region 72*a* below the upper rectangular section 72.

Further, the leg section 43 has a lower offset region 76 which cooperates with the clip element 42 and locking end tab 45 to define a region to receive the upper rectangular section 72, while providing a surface 76*a* to engage the upright web 74. Extending through the lower offset region 76 is a passage 77, while the clip element 42 is provided with a passage 42*a*, both to receive a fastener, such as a screw, rivet or the like (not shown), to positively secure the second and third couplers 30 and 32 to their respective locations, as may be required to comply with some local building codes. Other configurations may be provided for the leg section 43 to accommodate different versions of a t-bar section, including those not providing the rectangular section 72 for instance, while supporting its underlying function in the support brace 20 to provide support to the second accessory while bridging the location for the first accessory, in cantilevered or other configurations, without departing from the scope of the present disclosure.

Figure 4:
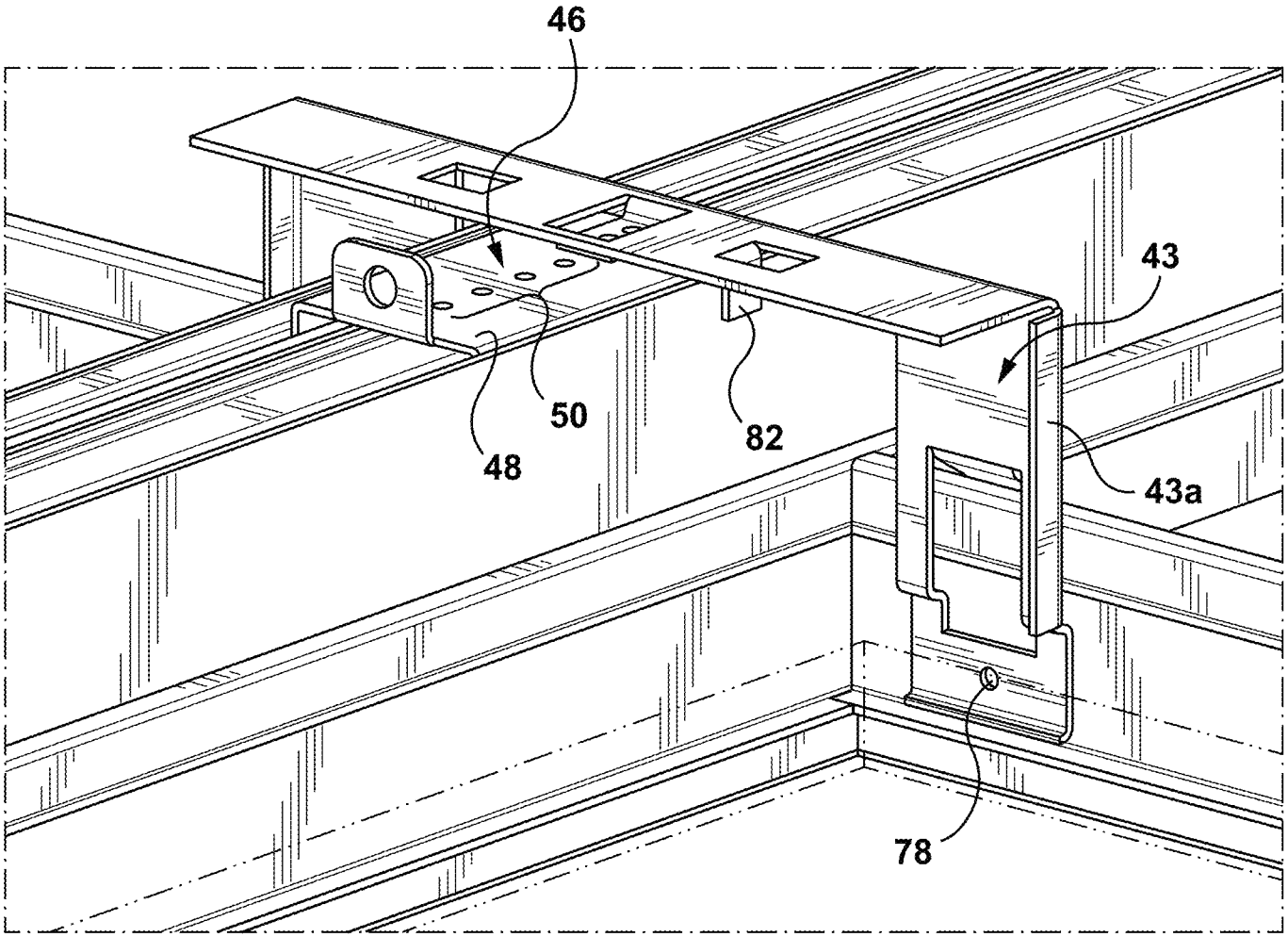

Referring to FIG. 4, the leg sections 43 are also provided with stiffening webs 43*a*, to provide additional stiffness for the leg sections in keeping with their clamping and support functions. Other configurations, without such stiffening webs 43*a* may also be deployed without departing from the scope of the present disclosure.

Referring to FIGS. 3, 4 and 5, a third coupler is provided at 46, with an accessory attachment location 48 and a support brace attachment location 50, for mounting the accessory to the support brace 20. In this case, the support brace attachment location 50 is provided in the form of a planar surface region with one or more first holes 50*a*, which are aligned with a central mounting flange 78 extending outwardly from the a central span 80 of the support brace 20. In this case, the central mounting flange 78 is punched (or otherwise formed) from the blank forming the central span 80 and has corresponding one or more second holes 78*a*, to align with a corresponding first hole 50*a* and be secured thereto with an appropriately sized fastener such as a screw, rivet or the like. Further, the central span 80 provides a pair of locators, which may be provided by way of locating webs 82 extending outwardly therefrom or other location configurations, and which serve a function to locate the fixture in the accessory locating region 22. The third coupler 46 also includes an anchor web 84 with a passage for wiring to an upper structure to comply with local building codes when required for secondary support purposes. Other configurations may be deployed to locate and/or mount the ceiling accessory in the accessory location region, without departing from the scope of the present disclosure, including the use of other housing configurations with integrally formed mounting formations which are complementary with the central mounting flange 78. Alternatively, the light fixture may be secured to ceiling infrastructure above the t-bar ceiling structure without necessarily being anchored to the support braces.

Figure 8:
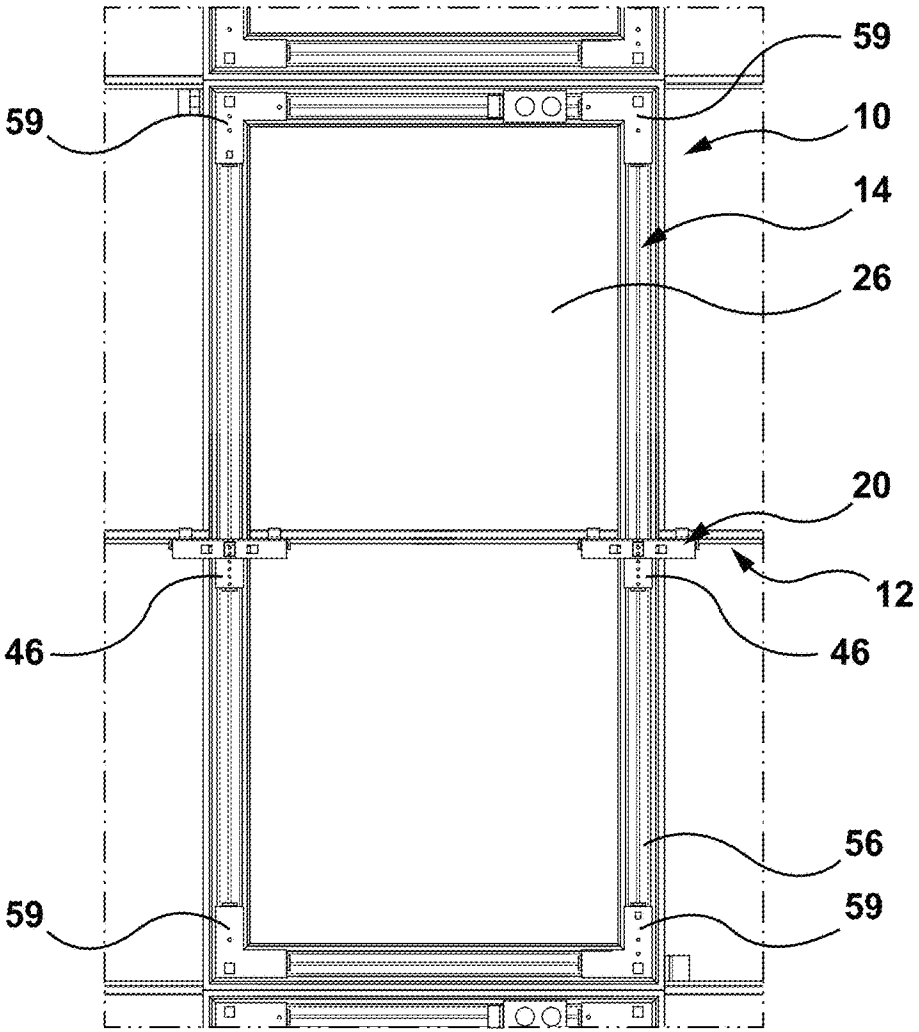
FIGS. 8 and 9 are top and bottom plan views, respectively, of the t-bar ceiling structure installation of FIG. 1.

In the exemplary embodiments of the figures, and as shown in FIGS. 3 and 5, the light fixture 14 is formed with a plurality, in this example four, extruded sections 54, and thus is configured with undercut grooves 56 extending longitudinally along an upper surface 58. The third coupler 46 has opposed anchor formations 60 to engage the undercut grooves 56 so that the third coupler 46 can slide along the upper surface 58 to a convenient location for mounting with the support brace 10. The extruded sections 54 may be joined at their ends to form corner regions, by way of corner connections as shown in FIG. 8 at 59, though other connection configurations may be deployed, such as corner inserts for extending into complementary inner spaces defined by the profile of the extruded sections 54, without departing from the scope of the present disclosure.

The light fixture 14 can be seen to extend along two or more edge regions of the designated opening 11, and in this example extends along the four edge regions of the designated opening 11. The light fixture 14 in this case is, in effect, a closed structure with an outer diameter that is dimensioned to align with the outer periphery of the designated opening 11, as defined by the inner exposed vertical faces 62 of the t-bar ceiling structure 12, and is supported on a lower support flange 64.

Similarly, the light fixture 14 has a pair of lower flanges, a first outer flange 66 to engage the lower support flange 64 on the t-bar ceiling structure 12, and a second opposite inner flange 68 which, when installed, faces inwardly into an inner opening defined by the light fixture 14. In this example, the first and second flanges 66 and 68 are offset, though they may also be in different relative configurations without departing from the scope of the present disclosure. For instance, the first and second flanges 66 and 68 may be parallel in some cases, depending at least in part on the cross section configuration(s) of t-bar elements used for the t-bar structure 12 and the t-bar ceiling structural unit 36. The second inner flange 68 is also configured to align with a lower support flange 70 of the neighboring t-bar ceiling structural unit 36, so that the second flange 68 and lower support flange 70 cooperate to support the ceiling panel 26. Thus, the light fixture 14 and the t-bar ceiling structural unit 36 include respective first and second ceiling panel support surfaces which cooperate to support the ceiling panel along respective edges thereof. While the light fixture shown in the figures is four sided, other configurations may also be implemented, including light fixtures whose housings extending along one, two or three sides, thus providing L- and U-shaped alternatives. T-shaped lighting fixtures may also be provided, without departing from the scope of the present disclosure.

To assemble a ceiling accessory, in the example of the light fixture 14, four extruded sections 54 are assembled with corner connectors 59 and with a number of third couplers 46 as needed slid into place in the undercut grooves to couple with a number of braces 20 to be deployed (unless the light fixture is not to be fastened thereto). A t-bar ceiling structure 12 is either assembled to form the designated opening 11 or is presented therewith. The light fixture 14, may then be installed, as mentioned above, in the accessory locating region 22, so that the light fixture 14 is then positioned adjacent the boundary of the designed opening 11, so that it can rest on the lower support flange 64. A plurality of support braces 20 may then be selected to be installed at spaced locations along a designated opening 11 in the t-bar ceiling structure 12 by anchoring the first coupler 30 on each support device 20 at a respective one of the spaced locations. A t-bar ceiling structural unit 36 may be then accessed, either from a collection of pre-formed units or by forming a unit, to fit inside the region bordered by the light fixture.

The light fixture 14 may then be attached to each of the support braces 20 by way of the third coupler 46, which may slid along the undercut grooves 56 to the desired alignment location with the central mounting flange 78 and fastened thereto, and to the light fixture 14. The ceiling panels 26 may then be installed on either side of the t-bar ceiling structural unit 36, and thus supported by the lower support flanges 64 on the t-bar ceiling structural unit 36 and the second inner flanges 68 on the light fixture 14, thereby to form an esthetic transition across the ceiling panel 26, the light fixture 14 and a finished appearance provided by the t-bar ceiling structure 12.

If desired, two or more of the support braces may be integrally formed into a one piece structure, without departing from the scope of the present disclosure. For instance, two or more of the support braces may be attached integrally with one or more t-bar structural units while providing the accessory location region as shown.

If desired, the ceiling accessory may be installed after the support braces, provided provision is made to enable the accessory to be placed on support flanges provided by the t-bar structure and/or the mounting configuration in the accessory location region.

While the extruded housing section 54 of the light fixture 14 is formed from an extruded construction, and the support brace is formed using metal blank punch/bending techniques, such components may be formed using a range of forming techniques, including those above mentioned, along with wire forming, plastics molding, 3D printing and the like, without departing from the scope of the present disclosure.

Figure 10:
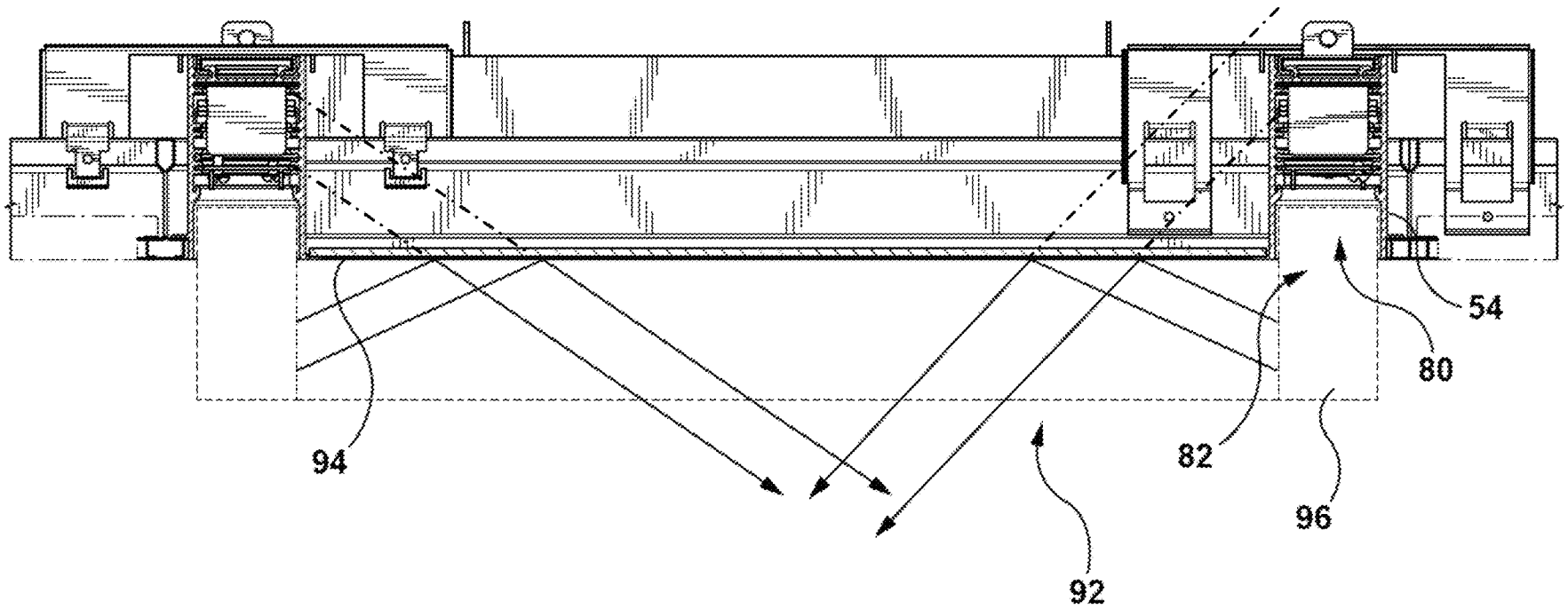
FIG. 10 is a sectional view of the installation of FIG. 1.
Figure 11:
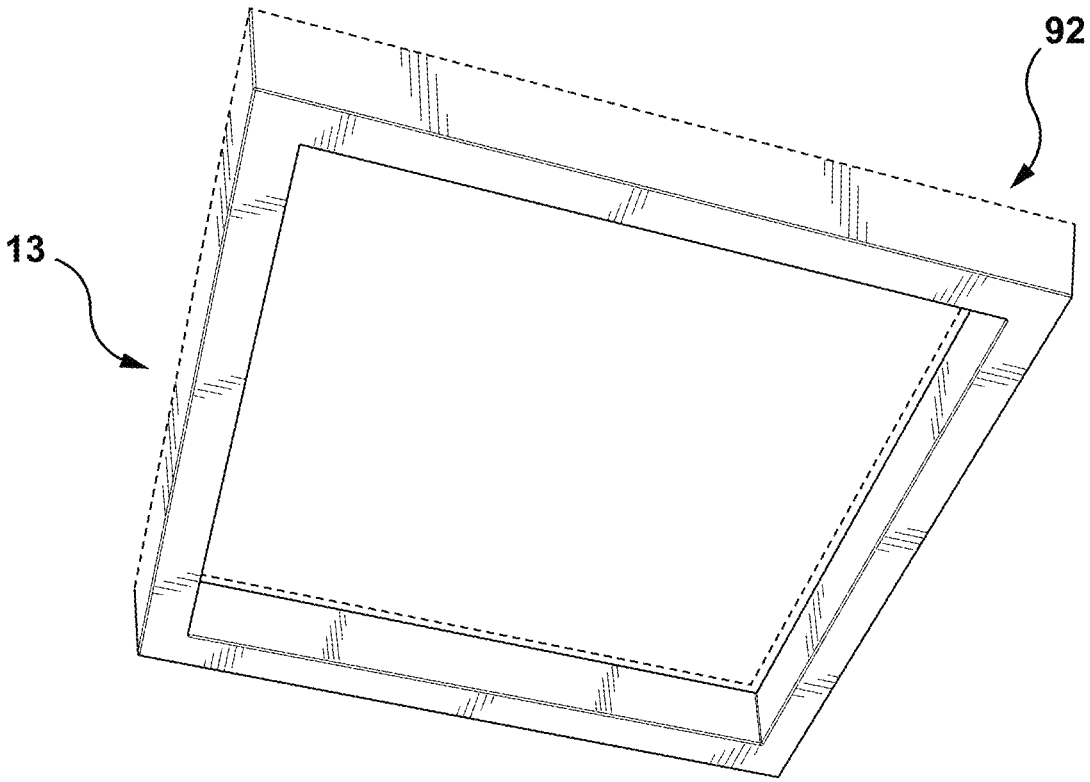
FIG. 11 is a perspective view of a lens for a light fixture.
Figure 12:
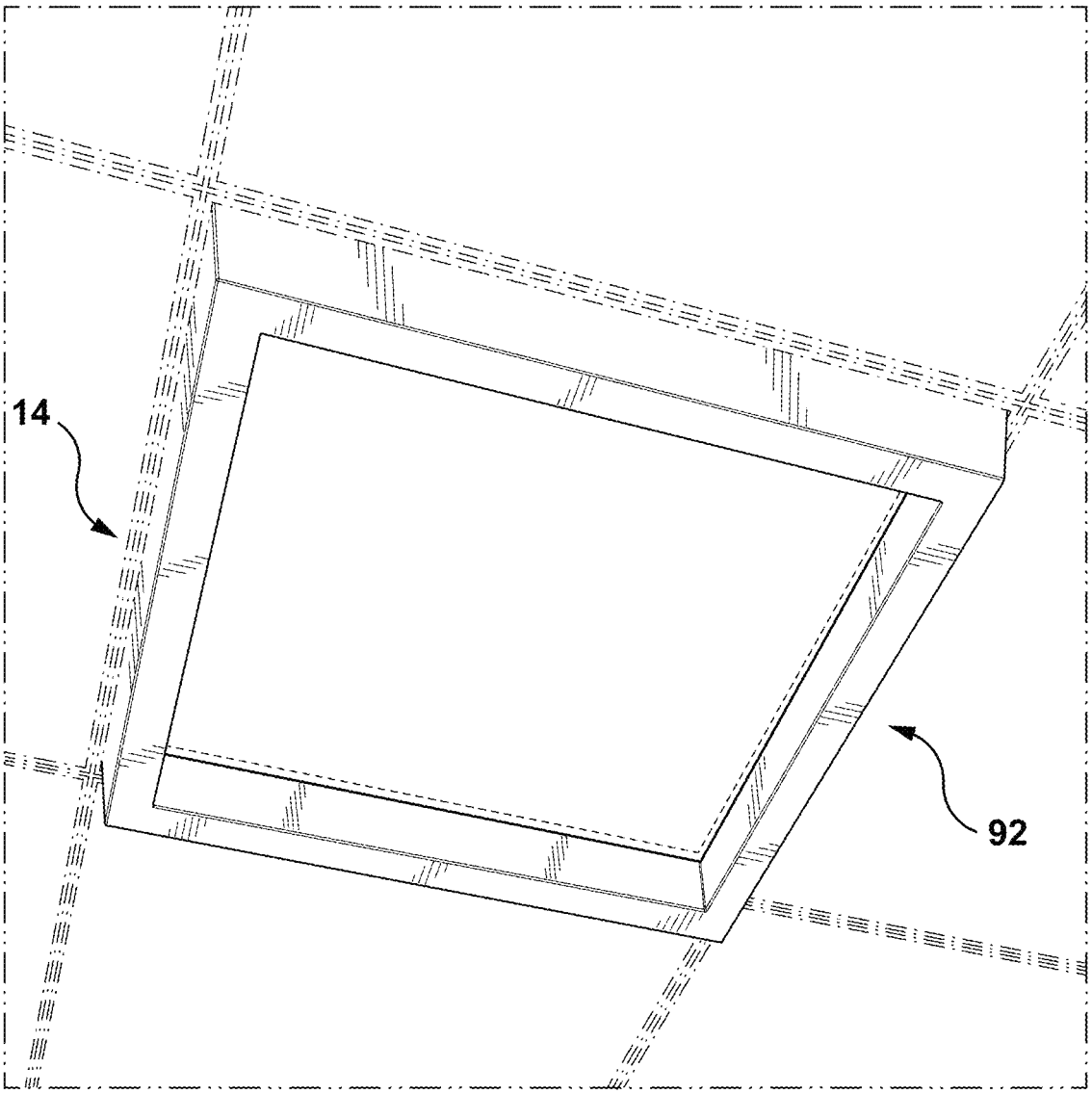
FIG. 12 is a perspective view of the lens in an installed configuration.
Figure 13:
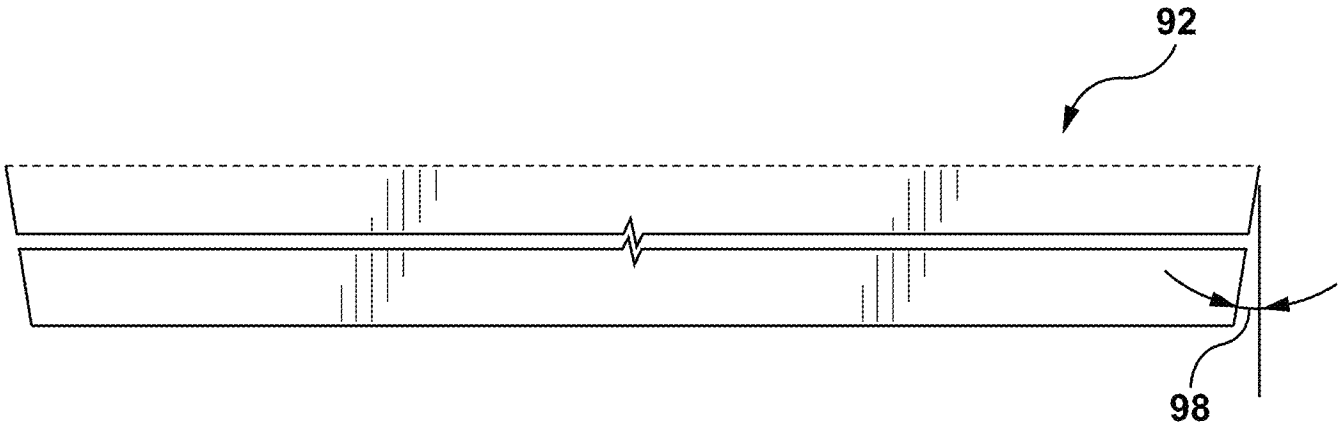
FIGS. 13 and 14 are side views of the lens along arrows 13 and 14 in FIGS. 11 and 12 respectively.
Figure 21:
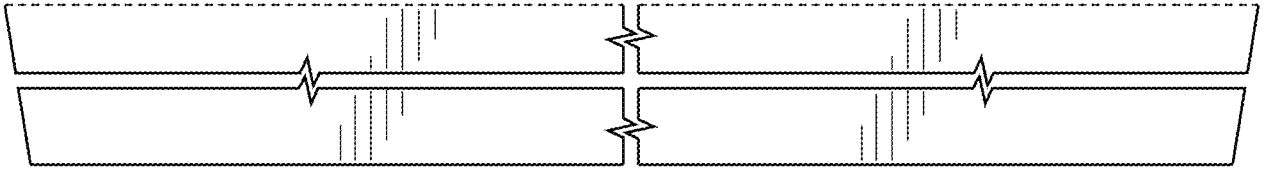
FIG. 21 is a side view taken on arrow 21 of FIG. 17.
Figure 14:
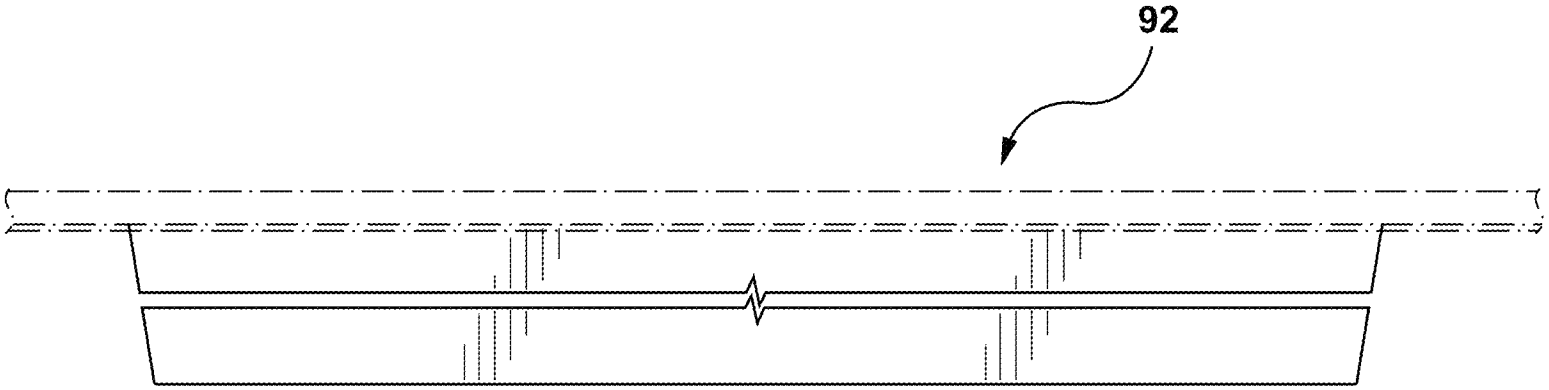
Figure 15:
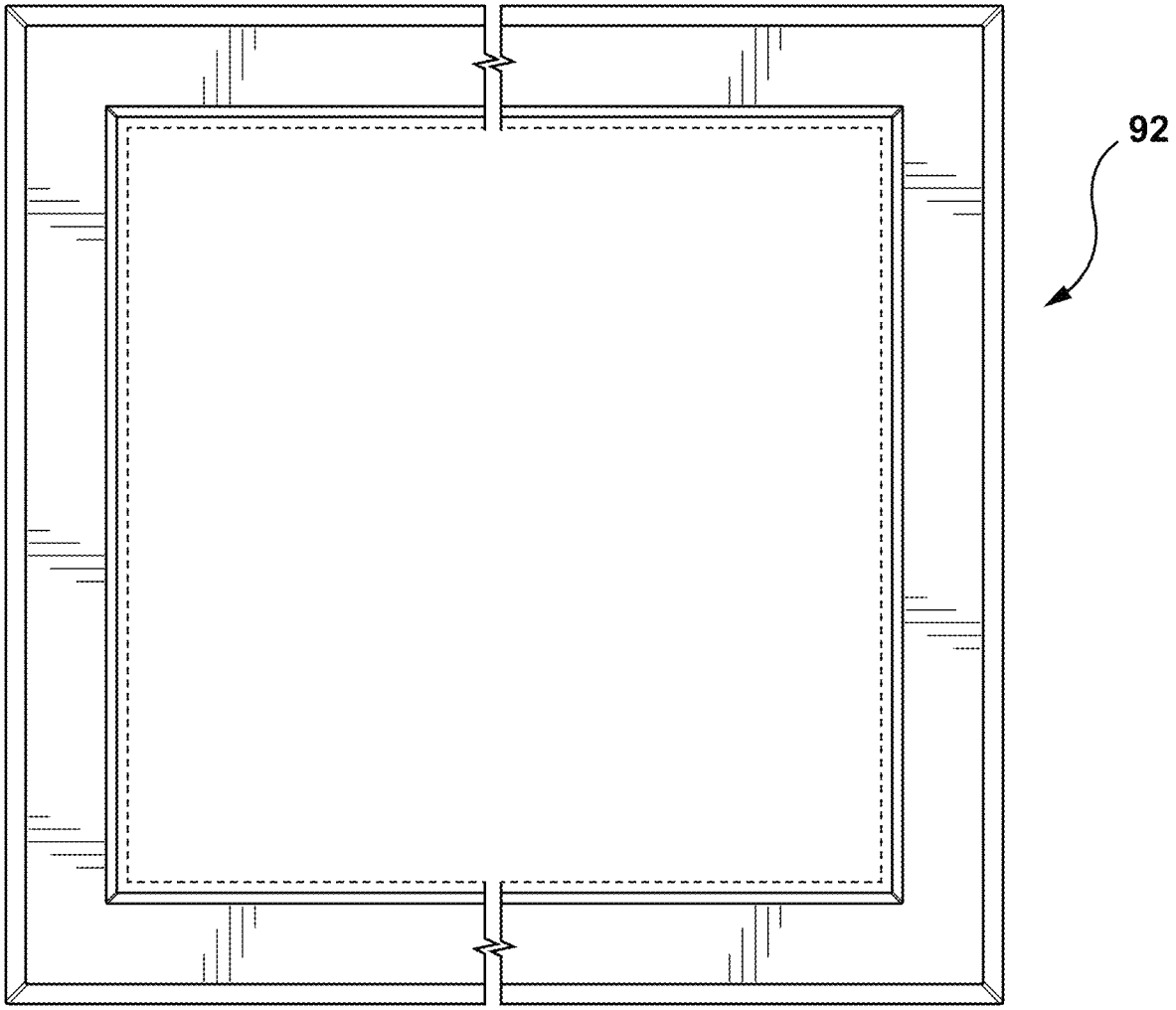
FIGS. 15 and 16 are bottom plan views of the lens according to FIGS. 10 and 11 respectively.
Figure 16:
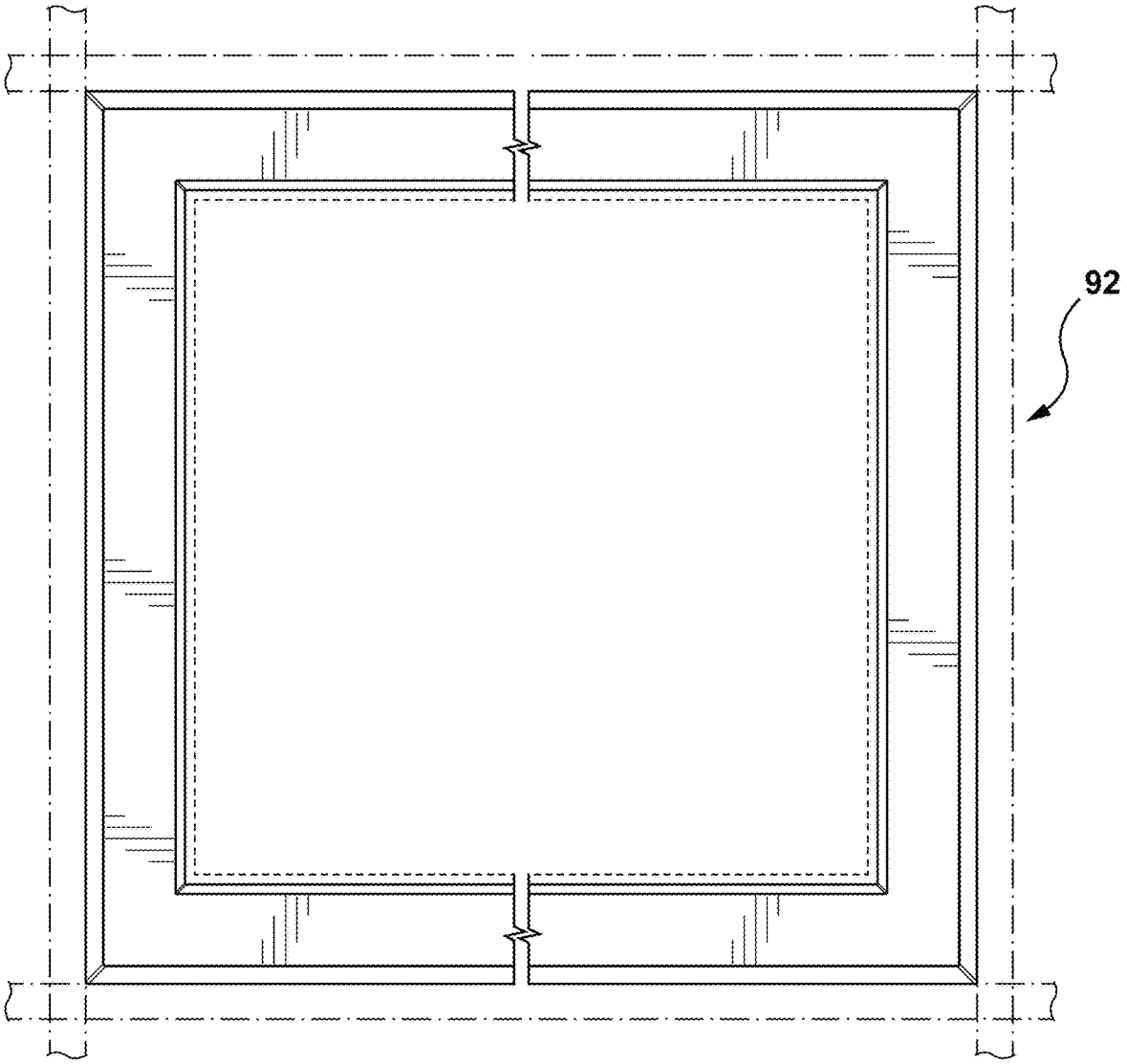
Figure 17:
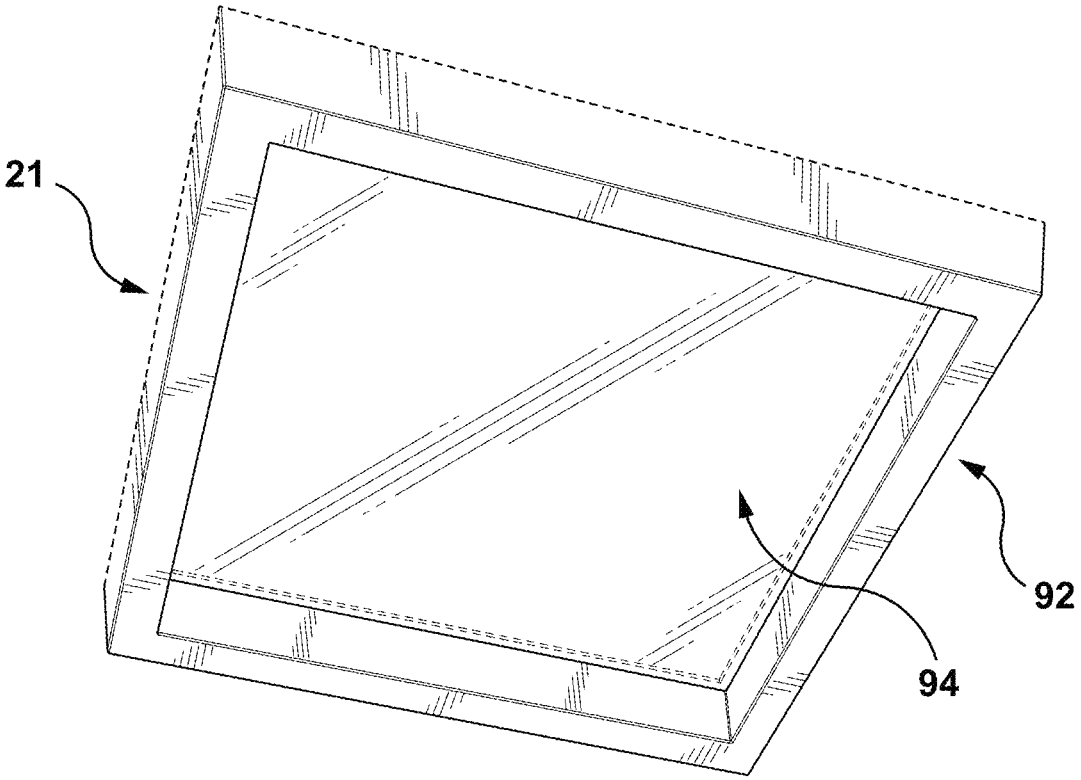
FIG. 17 is a perspective view of a lens for a light fixture, together with a central reflective surface.
Figure 18:
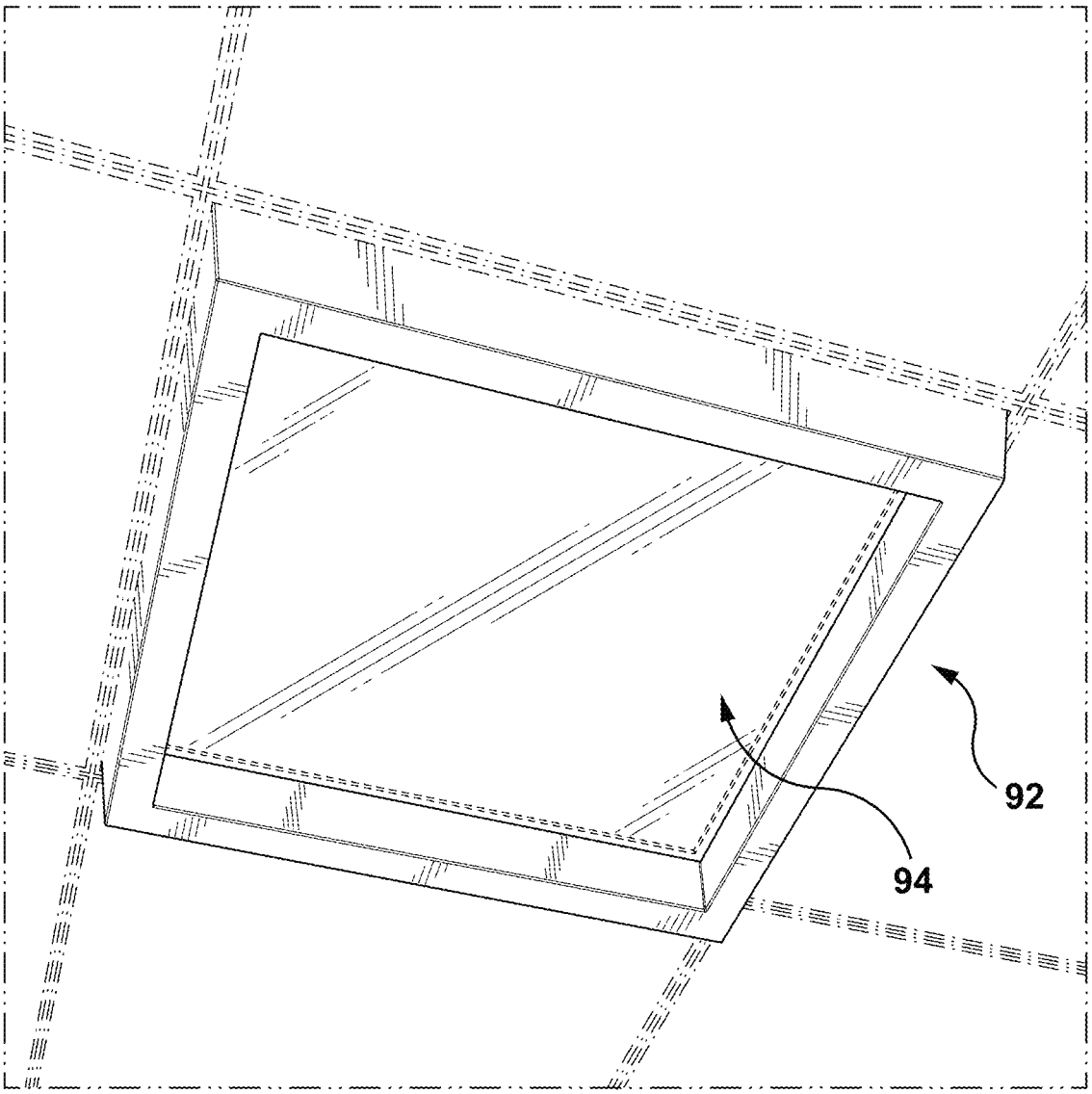
FIG. 18 is a perspective view of the lens in an installed configuration.
Figure 19:
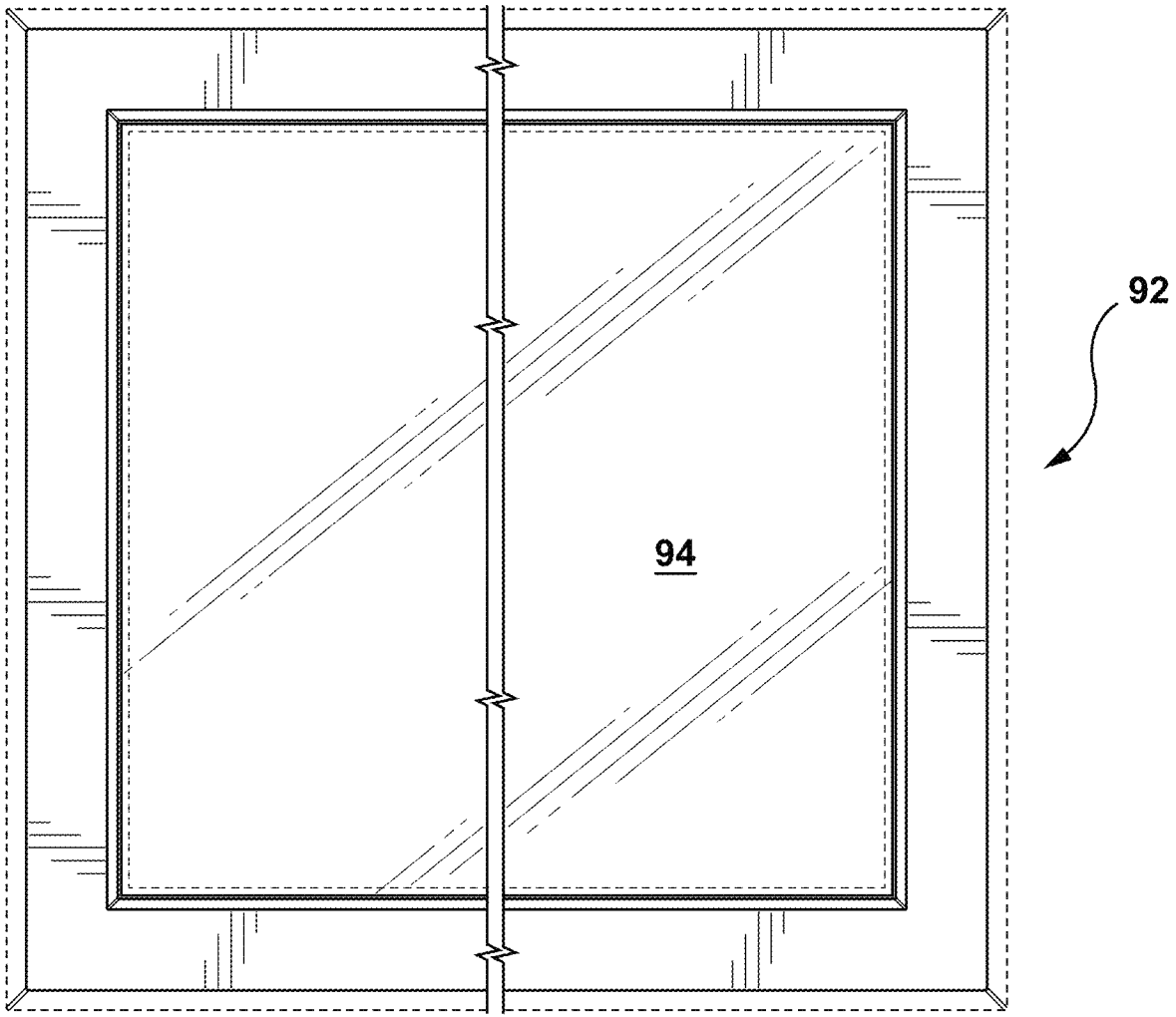
FIGS. 19, 22 and FIG. 20 are bottom plan views according to FIGS. 17 and 18 respectively.
Figure 20:
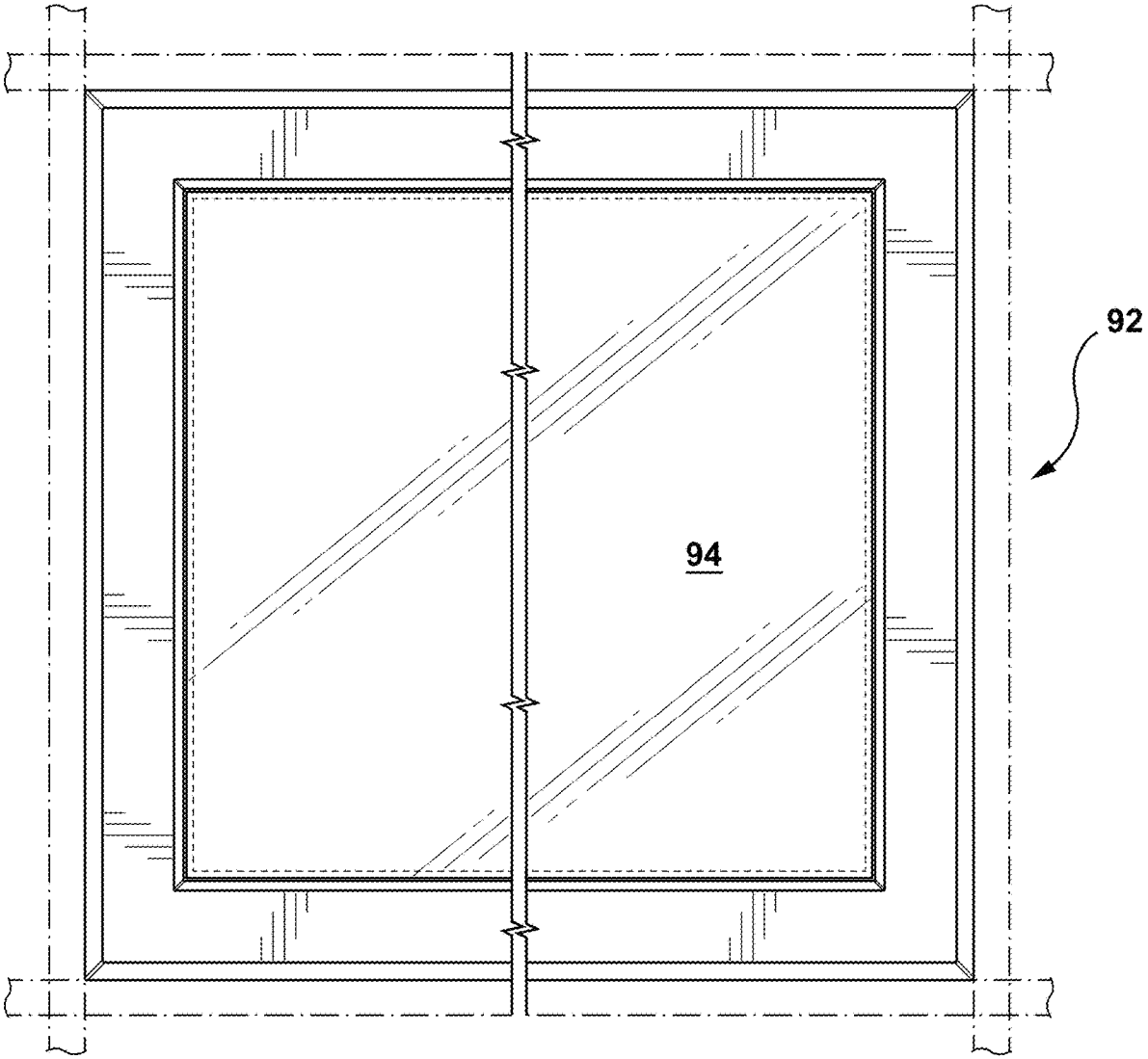
Figure 22:
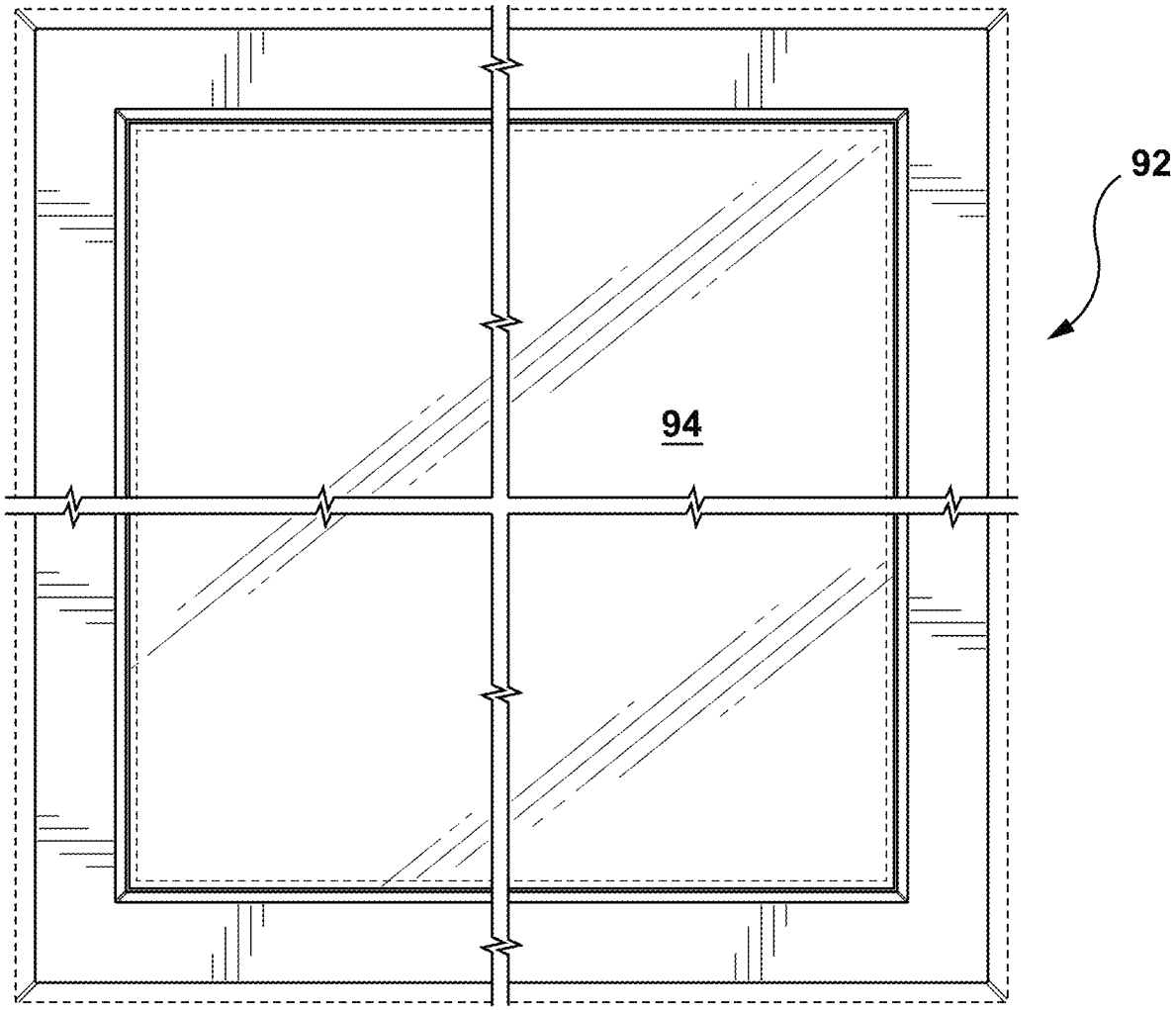
Figure 23:
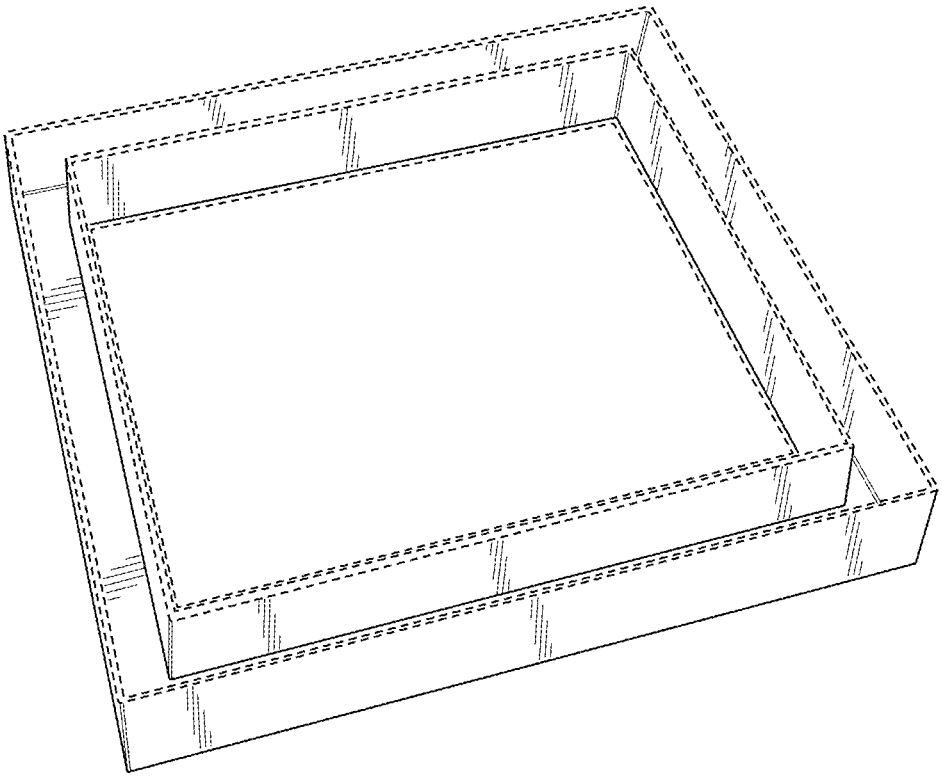
FIG. 23 is another perspective view of the lens according to FIG. 11.

As shown in the example of FIG. 10, the light fixture 14 thus provides a ring-shaped (annular) housing, formed from at least one housing section 54 (in this example extruded), to define a corresponding ring-shaped opening 80 along one peripheral region 82 thereof to receive a complementary ring-shaped lens (shown schematically in dashed lines at 92 in FIG. 10) therein. The lens itself may also, in this example, be extruded, and (as shown in FIG. 5) provides opposed free end regions shown at 93 with recessed cross-sectioned formations to engage complementary ridge formations 54*a* inside the housing section 54. Other configurations to couple the lens 92 with the housing section 54 may also be used, such as with complementary flanges, grooves, fasteners and the like, without departing from the scope of the present disclosure. The housing, in this example, is rectangular ring-shaped to form a rectangular inner region and thus borders an inner region which is configured to support a planar member therein to present an at least partially reflective surface 94, to at least partially reflect light from the lens. The light fixture 14 thus also provides a mounting configuration for installation in a designated opening in the t-bar ceiling structure.

The reflective surface 94 may be configured to be substantially coplanar with a corresponding plane of the t-bar ceiling structure as shown, or be at a spaced elevation relative thereto. The reflective surfaces 94 may be provided in the form of a brushed metal panel, such as stainless steel, or a mirrored surface, among others that may provide appropriate reflective surfaces.

As seen in FIG. 10, the lens 92 is configured to form a profile beyond the plane with at least a section of the lens bordering the reflective surface. The lens is, in this example, translucent and extends the entire periphery of the reflective surface. As with the housing, the lens 92 is elongate in cross section relative to the plane and provides a rectangular cross-sectional outer region 96, which may also be of other shapes such as circular, and be relatively more shallow (that is less elongate) thus to present a lower profile off the ceiling surface, as desired, and the housing may be other shapes other than ring-shaped, while still supporting the lens, without departing from the scope of the present disclosure.

The light fixture 14 as shown in FIG. 10, may present an improved lighting experience since the light leaving the fixture, from its inner surfaces, may be configured to reflect off the reflective surface 94 to giving a mirage like impression, in a transition zone near the lens 92, that the lens continues into and beyond the reflective surface.

FIGS. 11 to 16 show various features of the lens 92 and reflective surface, while FIGS. 17 to 23 show the lens 92 together with the reflective surface 94. In particular, FIGS. 13, 14 and 21 demonstrate that the lens may be provided with varying thicknesses and/or depths, while FIGS. 19, 20 and 22 demonstrate that the lens and/or the panel providing the reflective surface may be provided with varying width and/or length. The lens 92 may present a substantially continuous transparent, semitransparent, or translucent surface bordering the reflective panel, as shown, or may present a series of such surfaces, by way of alternating opaque sections as an example, or by interspersing a number of individual lens structures along the housing. The lens 92 may also be provided with varying cross sectional included angles, as shown at 98, without departing from the scope of the present disclosure.

While the present disclosure describes various exemplary embodiments, the disclosure is not so limited. To the contrary, the disclosure is intended to cover various modifications and equivalent arrangements, as will be readily appreciated by the person of ordinary skill in the art.

What is claimed is:

1. A support assembly for supporting ceiling accessories in a designated opening in a t-bar ceiling structure defining an outer planar presentation surface, comprising a plurality of support braces, each support brace configured to bridge a first ceiling accessory locating region alongside a corresponding boundary of the designated opening to receive a first ceiling accessory, each support brace configured to provide support for at least one second ceiling accessory to be positioned alongside the first ceiling accessory locating region and opposite the corresponding boundary of the designated opening, for the second and first ceiling accessories to complement a finished ceiling presentation provided by the t-bar ceiling structure.

2. An assembly as defined in claim 1, wherein the t-bar ceiling structure defines a first elevation, and wherein each support brace is configured to bridge the first ceiling accessory locating region at a second elevation upwardly spaced from the first elevation.

3. An assembly as defined in claim 2, each brace including a first coupler to couple with a designated t-bar ceiling structure, and a second coupler to couple with the second ceiling accessory.

4. An assembly as defined in claim 3, wherein the first and/or second couplers are adjustable relative to the brace.

5. An assembly as defined in claim 4, wherein at least one of the first and/or second couplers includes a fixed segment and a movable segment which is adjustably positionable relative thereto.

6. An assembly as defined in claim 5, wherein the fixed and movable segments include complementary passages which are alignable to receive at least one fastener, to fix the position of the movable segment.

7. An assembly as defined in claim 4, wherein the brace includes a central span portion to support the first and second couplers, the central span portion including a proximal span portion and a pair of distal span portions, at least one of which is adjustably fixable to the central span portion.

8. An assembly as defined in claim 1, wherein the first ceiling accessory is a light fixture.

9. An assembly as defined in claim 8, wherein the second ceiling accessory is a t-bar structural unit.

10. A support device for supporting one or more ceiling accessories in a designated opening in a t-bar ceiling structure, comprising a span portion configured to bridge a first accessory locating region alongside a corresponding boundary of the designated opening, a first coupler to couple with a designated sector of the t-bar ceiling structure near the designated opening, the span portion configured to provide support for at least one second accessory in the designated opening and alongside the first accessory locating region with the second accessory opposite the corresponding boundary, so that a first accessory and the second accessory are complementary with a finished ceiling presentation provided by the t-bar ceiling structure, wherein the t-bar ceiling structure defines a first elevation and the span portion is configured to bridge the first accessory locating region at a second elevation upwardly spaced from the first elevation, so that a lower boundary on the span portion corresponds to an upper boundary of the first accessory locating region.

11. A device as defined in claim 10, wherein the first accessory includes a light fixture and the second accessory includes a t-bar structural unit, further comprising a second coupler to couple with the t-bar structural unit, to extend through the designated opening to support one or more ceiling panels.

12. A device as defined in claim 11, wherein one or both of the first and second couplers are adjustable relative to the span portion.

13. A device as defined in claim 12, wherein one or both of the first and second couplers includes a leg and a clip biased toward the leg to engage a designated section of the t-bar ceiling structure or the t-bar structural unit, respectively.

* * * * *